US011992039B2

(12) United States Patent
Davis et al.

(10) Patent No.: US 11,992,039 B2
(45) Date of Patent: May 28, 2024

(54) CONSUMABLE FOR USE WITH APPARATUS FOR HEATING AEROSOLISABLE MATERIAL

(71) Applicant: NICOVENTURES TRADING LIMITED, London (GB)

(72) Inventors: Andrew Davis, London (GB); John Richardson, London (GB); Karl Kaljura, London (GB); Glen Elgar, London (GB); Walid Abi Aoun, London (GB)

(73) Assignee: NICOVENTURES TRADING LIMITED, London (GB)

( * ) Notice: Subject to any disclaimer, the term of this patent is extended or adjusted under 35 U.S.C. 154(b) by 599 days.

(21) Appl. No.: 17/250,504

(22) PCT Filed: Jul. 31, 2019

(86) PCT No.: PCT/EP2019/070736
§ 371 (c)(1),
(2) Date: Jan. 29, 2021

(87) PCT Pub. No.: WO2020/025738
PCT Pub. Date: Feb. 6, 2020

(65) Prior Publication Data

US 2021/0307383 A1 Oct. 7, 2021

(30) Foreign Application Priority Data

Jul. 31, 2018 (GB) ..... 1812490

(51) Int. Cl.
*A24D 1/20* (2020.01)
*A24B 15/167* (2020.01)
(Continued)

(52) U.S. Cl.
CPC ..... *A24D 1/20* (2020.01); *A24B 15/167* (2016.11); *A24F 40/20* (2020.01); *A24F 40/465* (2020.01)

(58) Field of Classification Search
CPC ..... A24D 1/20; A24F 40/465; A24F 40/20
(Continued)

(56) References Cited

U.S. PATENT DOCUMENTS 4,553,556 A 11/1985 Lephardt
5,353,813 A 10/1994 Deevi et al.
(Continued)

FOREIGN PATENT DOCUMENTS

EP 0160380 B1 6/1989
JP 2015512262 A 4/2015

OTHER PUBLICATIONS

International Searching Authority in connection with PCT/EP2019/070736 filed Jul. 31, 2019, "The International Search Report and the Written Opinion of the International Searching Authority, or the Declaration", 23 pages, dated Feb. 13, 2020.

*Primary Examiner* — Gary F Paumen
(74) *Attorney, Agent, or Firm* — McKee, Voorhees & Sease, PLC

(57) ABSTRACT

Disclosed is a consumable for use with apparatus for heating aerosolisable material to volatilise at least one component of the aerosolisable material. The consumable comprises an outer tube, an inner member inside the outer tube, and at least one support that supports the inner member relative to the outer tube so that at least one air gap exists between the inner member and the outer tube. At least one of the inner member, the outer tube and the support comprises aerosolisable material that is heatable to generate aerosol in the air gap. The consumable has at least one outlet for permitting the aerosol to pass out of consumable from the air gap.

24 Claims, 2 Drawing Sheets

(51) Int. Cl.
*A24F 40/20* (2020.01)
*A24F 40/465* (2020.01)

(58) Field of Classification Search
USPC ..... 131/329
See application file for complete search history.

(56) References Cited

U.S. PATENT DOCUMENTS

| | | | | |
|---|---|---|---|---|
| 10,772,355 | B2 * | 9/2020 | Zuber | A61M 11/042 |
| 2013/0037041 | A1 | 2/2013 | Worm et al. | |
| 2013/0255702 | A1 | 10/2013 | Griffith, Jr. et al. | |
| 2017/0055581 | A1 | 3/2017 | Wilke et al. | |
| 2017/0119054 | A1 | 5/2017 | Zinovik et al. | |
| 2018/0027884 | A1 | 2/2018 | Zuber et al. | |

* cited by examiner

CONSUMABLE FOR USE WITH APPARATUS FOR HEATING AEROSOLISABLE MATERIAL

CROSS REFERENCE TO RELATED APPLICATIONS

This is a U.S. national phase application claiming priority to PCT/EP2019/070736, filed Jul. 31, 2019, which claims priority to United Kingdom (GB) application No. 1812490.9, filed Jul. 31, 2018, the entire contents of which are hereby incorporated by reference in their entirety.

TECHNICAL FIELD

The present invention relates to consumables for use with apparatus for heating aerosolisable material, and to systems comprising such a consumable and an apparatus for heating aerosolisable material of the consumable to volatilise at least one component of the aerosolisable material.

BACKGROUND

Smoking articles such as cigarettes, cigars and the like burn tobacco during use to create tobacco smoke. Attempts have been made to provide alternatives to these articles by creating products that release compounds without combusting. Examples of such products are so-called "heat not burn" products or tobacco heating devices or products, which release compounds by heating, but not burning, material. The material may be, for example, tobacco or other non-tobacco products, which may or may not contain nicotine.

SUMMARY

A first aspect of the present invention provides a consumable for use with apparatus for heating aerosolisable material to volatilise at least one component of the aerosolisable material, wherein the consumable comprises:

- an outer tube, an inner member inside the outer tube, and at least one support that supports the inner member relative to the outer tube so that at least one air gap exists between the inner member and the outer tube;
- wherein at least one of the inner member, the outer tube and the support comprises aerosolisable material that is heatable to generate aerosol in the air gap; and
- wherein the consumable has at least one outlet for permitting the aerosol to pass out of consumable from the air gap.

In an exemplary embodiment, the at least one support comprises a plurality of supports that are circumferentially spaced from each other.

In an exemplary embodiment, the at least one support is located between the inner member and the outer tube.

In an exemplary embodiment, the at least one support comprises an annular non-circular support between the inner member and the outer tube.

In an exemplary embodiment, the at least one support comprises a folded or corrugated element between the inner member and the outer tube.

In an exemplary embodiment, the or each support is located at an axial end of the consumable.

In an exemplary embodiment, at least one of the inner member and the outer tube comprises the aerosolisable material.

In an exemplary embodiment, the at least one of the inner member and the outer tube comprises a carrier, and the aerosolisable material is affixed to the carrier. In an exemplary embodiment, the aerosolisable material is coated on the carrier, such as by spraying, electro-spraying, casting or band-casting.

A second aspect of the present invention provides a consumable for use with apparatus for heating aerosolisable material to volatilise at least one component of the aerosolisable material, wherein the consumable comprises:

- an outer tube; and
- an inner member inside the outer tube, wherein at least part of the inner member is spaced from the outer tube by at least one air gap, and wherein the inner member comprises aerosolisable material that is heatable to generate aerosol in the air gap;
- wherein the consumable has at least one outlet for permitting the aerosol to pass out of consumable from the air gap.

In an exemplary embodiment, the inner member comprises a carrier, and the aerosolisable material is affixed to the carrier. In an exemplary embodiment, the aerosolisable material is coated on the carrier, such as by spraying, electro-spraying, casting or band-casting.

In an exemplary embodiment of the consumable of the first aspect or the second aspect, the aerosolisable material comprises an amorphous solid.

A third aspect of the present invention provides a consumable for use with apparatus for heating aerosolisable material to volatilise at least one component of the aerosolisable material, wherein the consumable comprises:

- an outer tube;
- an inner member inside the outer tube, wherein at least part of the inner member is spaced from the outer tube by at least one air gap; and
- aerosolisable material comprising an amorphous solid that is heatable to generate aerosol in the air gap;
- wherein the consumable has at least one outlet for permitting the aerosol to pass out of consumable from the air gap.

In an exemplary embodiment of the consumable of the third aspect, at least one of the inner member and the outer tube comprises the aerosolisable material.

In an exemplary embodiment of the consumable of any one of the first to third aspects, at least one of the inner member and the outer tube is circular.

In an exemplary embodiment of the consumable of any one of the first to third aspects, at least one of the inner member and the outer tube is non-circular.

In an exemplary embodiment of the consumable of any one of the first to third aspects, at least one of the inner member and the outer tube is corrugated.

In an exemplary embodiment of the consumable of any one of the first to third aspects, the inner member and the outer tube are concentric.

In an exemplary embodiment of the consumable of any one of the first to third aspects, the inner member comprises an inner tube.

In an exemplary embodiment, the inner tube is located around a passageway that opens at an axial end of the consumable so that a heating element for heating the aerosolisable material is insertable into the passageway in use. In an exemplary embodiment, the passageway extends only partially along a length or axial dimension of the consumable. In an exemplary embodiment, the passageway extends for least a majority of a length or axial dimension of the consumable. In an exemplary embodiment, the passageway extends fully through the consumable from a first axial end of the consumable to an opposite second axial end of the consumable.

In an exemplary embodiment of the consumable of any one of the first to third aspects, the at least one outlet is at an axial end of the consumable.

In an exemplary embodiment of the consumable of any one of the first to third aspects, the inner tube is located around a passageway that opens at a first axial end of the consumable, and the at least one outlet is at a second axial end of the consumable that is opposite to the first axial end of the consumable.

In an exemplary embodiment of the consumable of any one of the first to third aspects, the at least one outlet is at an axial end of the consumable and the inner tube is located around a passageway that opens at the same axial end of the consumable.

In an exemplary embodiment of the consumable of any one of the first to third aspects, the air gap extends only partially along a length or axial dimension of the consumable.

In an exemplary embodiment of the consumable of any one of the first to third aspects, the air gap extends for least a majority of a length or axial dimension of the consumable.

In an exemplary embodiment of the consumable of any one of the first to third aspects, the air gap extends fully through the consumable from a first axial end of the consumable to an opposite second axial end of the consumable.

In an exemplary embodiment of the consumable of any one of the first to third aspects, the consumable is non-combustible.

In an exemplary embodiment of the consumable of any one of the first to third aspects, the consumable comprises heating material that is heatable by penetration with a varying magnetic field to thereby heat the aerosolisable material.

In an exemplary embodiment, the heating material comprises one or more materials selected from the group consisting of: an electrically-conductive material, a magnetic material, and a magnetic electrically-conductive material.

In an exemplary embodiment, the heating material comprises a metal or a metal alloy.

In an exemplary embodiment, the heating material comprises one or more materials selected from the group consisting of: aluminium, gold, iron, nickel, cobalt, conductive carbon, graphite, steel, plain-carbon steel, mild steel, stainless steel, ferritic stainless steel, molybdenum, silicon carbide, copper, and bronze.

In an exemplary embodiment, at least one of the inner member and the outer tube comprises the heating material.

In an exemplary embodiment of the consumable of the first aspect, the at least one support comprises the heating material.

A fourth aspect of the present invention provides a system for heating aerosolisable material to volatilise at least one component of the aerosolisable material, the system comprising:

the consumable of any one of the first to third aspects; and apparatus for heating the aerosolisable material of the consumable to volatilise at least one component of the aerosolisable material, the apparatus comprising a heating zone for receiving the consumable, and a device for causing heating of the aerosolisable material when the consumable is in the heating zone.

In an exemplary embodiment, the device comprises a magnetic field generator for generating a varying magnetic field for penetrating the heating zone when the consumable is in the heating zone.

In an exemplary embodiment, the device of the apparatus comprises a heatable heating element in the heating zone; and wherein the inner member of the consumable comprises an inner tube that is located around a passageway that opens at an axial end of the consumable so that the heating element is insertable into the passageway.

In an exemplary embodiment, the heatable heating element has an outer cross-sectional shape, and the inner member of the consumable comprises an inner tube having an inner cross-sectional shape that matches the outer cross-sectional shape of the heating element.

In an exemplary embodiment, the device for causing heating of the aerosolisable material when the consumable is in the heating zone is configured for heating different sections of the heating zone independently of each other.

Further aspects of the present invention may provide the use of the consumable of the first or second or third aspect of the present invention in the generation of an inhalable aerosol.

BRIEF DESCRIPTION OF THE DRAWINGS

Embodiments of the invention will now be described, by way of example only, with reference to the accompanying drawings, in which.

DETAILED DESCRIPTION

Figure 1:
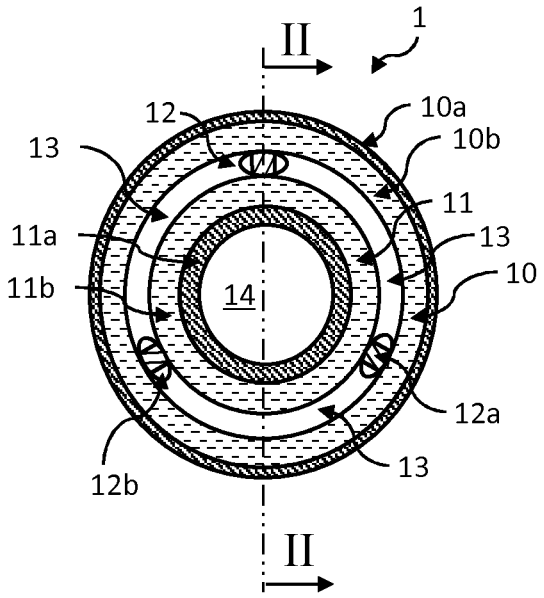
FIG. 1 shows a schematic cross-sectional end view of an example of a consumable for use with apparatus for heating aerosolisable material to volatilise at least one component of the aerosolisable material.

As used herein, the term "aerosolisable material" includes materials that provide volatilised components upon heating, typically in the form of vapour or an aerosol. "Aerosolisable material" may be a non-tobacco-containing material or a tobacco-containing material. "Aerosolisable material" may, for example, include one or more of tobacco per se, tobacco derivatives, expanded tobacco, reconstituted tobacco, tobacco extract, homogenised tobacco or tobacco substitutes. The aerosolisable material can be in the form of ground tobacco, cut rag tobacco, extruded tobacco, reconstituted tobacco, reconstituted aerosolisable material, liquid, gel, gelled sheet, powder, agglomerates, or the like. "Aerosolisable material" also may include other, non-tobacco, products, which, depending on the product, may or may not contain nicotine. "Aerosolisable material" may comprise one or more humectants, such as glycerol or propylene glycol.

In some embodiments, the aerosolisable material comprises an "amorphous solid", which may alternatively be referred to as a "monolithic solid" (i.e. non-fibrous), or as a "dried gel". The amorphous solid is a solid material that may retain some fluid, such as liquid, within it. In some cases, the aerosolisable material comprises from about 50 wt %, 60 wt % or 70 wt % of amorphous solid, to about 90 wt %, 95 wt % or 100 wt % of amorphous solid. In some cases, the aerosolisable material consists of amorphous solid.

"Aerosolisable material" also may include other, non-tobacco, products, which, depending on the product, may or may not contain nicotine. "Aerosolisable material" may comprise one or more humectants, such as glycerol or propylene glycol.

The amorphous solid may be formed as a sheet. It may be incorporated into the consumable in sheet form. In some cases, the aerosolisable material may be included as a planar sheet, as a bunched or gathered sheet, as a crimped sheet, or as a rolled sheet (i.e. in the form of a tube). In some such cases, the amorphous solid of these embodiments may be included in a consumable or system as a sheet, such as a sheet circumscribing a rod of aerosolisable material (e.g. tobacco). In some other cases, the aerosolisable material may be formed as a sheet and then shredded and incorporated into the consumable. In some cases, the shredded sheet may be mixed with cut rag tobacco and incorporated into the consumable.

In some cases, the amorphous solid may comprise 1-60 wt % of a gelling agent wherein these weights are calculated on a dry weight basis.

Suitably, the amorphous solid may comprise from about 1 wt %, 5 wt %, 10 wt %, 15 wt %, 20 wt % or 25 wt % to about 60 wt %, 50 wt %, 45 wt %, 40 wt %, 35 wt %, 30 wt % or 27 wt % of a gelling agent (all calculated on a dry weight basis). For example, the amorphous solid may comprise 1-50 wt %, 5-40 wt %, 10-30 wt % or 15-27 wt % of a gelling agent.

In some embodiments, the gelling agent comprises a hydrocolloid. In some embodiments, the gelling agent comprises one or more compounds selected from the group comprising alginates, pectins, starches (and derivatives), celluloses (and derivatives), gums, silica or silicones compounds, clays, polyvinyl alcohol and combinations thereof. For example, in some embodiments, the gelling agent comprises one or more of alginates, pectins, hydroxyethyl cellulose, hydroxypropyl cellulose, carboxymethylcellulo se, pullulan, xanthan gum guar gum, carrageenan, agarose, acacia gum, fumed silica, PDMS, sodium silicate, kaolin and polyvinyl alcohol. In some cases, the gelling agent comprises alginate and/or pectin, and may be combined with a setting agent (such as a calcium source) during formation of the amorphous solid. In some cases, the amorphous solid may comprise a calcium-crosslinked alginate and/or a calcium-crosslinked pectin.

In some embodiments, the gelling agent comprises alginate, and the alginate is present in the amorphous solid in an amount of from 10-30 wt % of the amorphous solid (calculated on a dry weight basis). In some embodiments, alginate is the only gelling agent present in the amorphous solid. In other embodiments, the gelling agent comprises alginate and at least one further gelling agent, such as pectin.

In some embodiments the amorphous solid may include gelling agent comprising carrageenan.

Suitably, the amorphous solid may comprise from about 5 wt %, 10 wt %, 15 wt %, or 20 wt % to about 80 wt %, 70 wt %, 60 wt %, 55 wt %, 50 wt %, 45 wt % 40 wt %, or 35 wt % of an aerosol generating agent (all calculated on a dry weight basis). The aerosol generating agent may act as a plasticiser. For example, the amorphous solid may comprise 10-60 wt %, 15-50 wt % or 20-40 wt % of an aerosol generating agent. In some cases, the aerosol generating agent comprises one or more compound selected from erythritol, propylene glycol, glycerol, triacetin, sorbitol and xylitol. In some cases, the aerosol generating agent comprises, consists essentially of or consists of glycerol. The inventors have established that if the content of the plasticiser is too high, the amorphous solid may absorb water resulting in a material that does not create an appropriate consumption experience in use. The inventors have established that if the plasticiser content is too low, the amorphous solid may be brittle and easily broken. The plasticiser content specified herein provides an amorphous solid flexibility which allows the amorphous solid sheet to be wound onto a bobbin, which is useful in manufacture of aerosol generating articles.

In some cases, the amorphous solid may comprise a flavour. Suitably, the amorphous solid may comprise up to about 60 wt %, 50 wt %, 40 wt %, 30 wt %, 20 wt %, 10 wt % or 5 wt % of a flavour. In some cases, the amorphous solid may comprise at least about 0.1 wt %, 0.5 wt %, 1 wt %, 2 wt %, 5 wt % 10 wt %, 20 wt % or 30 wt % of a flavour (all calculated on a dry weight basis). For example, the amorphous solid may comprise 0.1-60 wt % m, 1-60 wt %, 5-60 wt %, 10-60 wt %, 20-50 wt % or 30-40 wt % of a flavour. In some cases, the flavour (if present) comprises, consists essentially of or consists of menthol. In some cases, the amorphous solid does not comprise a flavour.

In some cases, the amorphous solid additionally comprises an active substance. For example, in some cases, the amorphous solid comprises a tobacco material and/or nicotine. For example, the amorphous solid may comprise powdered tobacco and/or nicotine and/or a tobacco extract. In some cases, the amorphous solid may comprise from about 1 wt %, 5 wt %, 10 wt %, 15 wt %, 20 wt % or 25 wt % to about 70 wt %, 50 wt %, 45 wt % or 40 wt % (calculated on a dry weight basis) of active substance. In some cases, the amorphous solid may comprise from about 1 wt %, 5 wt %, 10 wt %, 15 wt %, 20 wt % or 25 wt % to about 70 wt %, 60 wt %, 50 wt %, 45 wt % or 40 wt % (calculated on a dry weight basis) of a tobacco material and/or nicotine.

In some cases, the amorphous solid comprises an active substance such as tobacco extract. In some cases, the amorphous solid may comprise 5-60 wt % (calculated on a dry weight basis) of tobacco extract. In some cases, the amorphous solid may comprise from about 5 wt %, 10 wt %, 15 wt %, 20 wt % or 25 wt % to about 55 wt %, 50 wt %, 45 wt % or 40 wt % (calculated on a dry weight basis) tobacco extract. For example, the amorphous solid may comprise 5-60 wt %, 10-55 wt % or 25-55 wt % of tobacco extract. The tobacco extract may contain nicotine at a concentration such that the amorphous solid comprises 1 wt % 1.5 wt %, 2 wt % or 2.5 wt % to about 6 wt %, 5 wt %, 4.5 wt % or 4 wt % (calculated on a dry weight basis) of nicotine. In some cases, there may be no nicotine in the amorphous solid other than that which results from the tobacco extract.

In some embodiments the amorphous solid comprises no tobacco material but does comprise nicotine. In some such cases, the amorphous solid may comprise from about 1 wt %, 2 wt %, 3 wt % or 4 wt % to about 20 wt %, 15 wt %, 10 wt % or 5 wt % (calculated on a dry weight basis) of nicotine. For example, the amorphous solid may comprise 1-20 wt % or 2-5 wt % of nicotine.

In some cases, the total content of active substance and/or flavour may be at least about 0.1 wt %, 1 wt %, 5 wt %, 10 wt %, 20 wt %, 25 wt % or 30 wt %. In some cases, the total content of active substance and/or flavour may be less than about 80 wt %, 70 wt %, 60 wt %, 50 wt % or 40 wt % (all calculated on a dry weight basis).

In some cases, the total content of tobacco material, nicotine and flavour may be at least about 1 wt %, 5 wt %, 10 wt %, 20 wt %, 25 wt % or 30 wt %. In some cases, the total content of tobacco material, nicotine and flavour may be less than about 70 wt %, 60 wt %, 50 wt % or 40 wt % (all calculated on a dry weight basis).

In some cases, the amorphous solid comprises from about 1 wt % to about 15 wt % water, or from about 5 wt % to about 15 wt % calculated on a wet weight basis. Suitably, the water content of the amorphous solid may be from about 5 wt %, 7 wt % or 9 wt % to about 15 wt %, 13 wt % or 11 wt % (WWB), most suitably about 10 wt %.

In some embodiments, the amorphous solid is a hydrogel and comprises less than about 20 wt % of water calculated on a wet weight basis. In some cases, the hydrogel may comprise less than about 15 wt %, 12 wt % or 10 wt % of water calculated on a wet weight basis (WWB). In some cases, the hydrogel may comprise at least about 2 wt % or at least about 5 wt % of water (WWB).

The amorphous solid may be made from a gel, and this gel may additionally comprise a solvent, included at 0.1-50 wt %. However, the inventors have established that the inclusion of a solvent in which the flavour is soluble may reduce the gel stability and the flavour may crystallise out of the gel. As such, in some cases, the gel does not include a solvent in which the flavour is soluble.

In some embodiments, the amorphous solid comprises less than 60 wt % of a filler, such as from 1 wt % to 60 wt %, or 5 wt % to 50 wt %, or 5 wt % to 30 wt %, or 10 wt % to 20 wt %.

In other embodiments, amorphous solid comprises less than 20 wt %, suitably less than 10 wt % or less than 5 wt % of a filler. In some cases, the amorphous solid comprises less than 1 wt % of a filler, and in some cases, comprises no filler.

The filler, if present, may comprise one or more inorganic filler materials, such as calcium carbonate, perlite, vermiculite, diatomaceous earth, colloidal silica, magnesium oxide, magnesium sulphate, magnesium carbonate, and suitable inorganic sorbents, such as molecular sieves. The filler may comprise one or more organic filler materials such as wood pulp, cellulose and cellulose derivatives. In particular cases, the amorphous solid comprises no calcium carbonate such as chalk.

In particular embodiments which include filler, the filler is fibrous. For example, the filler may be a fibrous organic filler material such as wood pulp, hemp fibre, cellulose or cellulose derivatives. Without wishing to be bound by theory, it is believed that including fibrous filler in an amorphous solid may increase the tensile strength of the material. This may be particularly advantageous in examples wherein the amorphous solid is provided as a sheet, such as when an amorphous solid sheet circumscribes a rod of aerosolisable material.

In some embodiments, the amorphous solid does not comprise tobacco fibres. In particular embodiments, the amorphous solid does not comprise fibrous material.

In some embodiments, the aerosol generating material does not comprise tobacco fibres. In particular embodiments, the aerosol generating material does not comprise fibrous material.

In some embodiments, the aerosol generating substrate does not comprise tobacco fibres. In particular embodiments, the aerosol generating substrate does not comprise fibrous material.

In some embodiments, the consumable does not comprise tobacco fibres. In particular embodiments, the consumable does not comprise fibrous material.

In some cases, the amorphous solid may consist essentially of, or consist of a gelling agent, an aerosol generating agent, a tobacco material and/or a nicotine source, water, and optionally a flavour.

A method of making an aerosolisable material may comprise (a) forming a slurry comprising components of the amorphous solid or precursors thereof, (b) forming a layer of the slurry, and (c) setting the slurry to form a gel and (d) drying to form an amorphous solid.

The step (b) of forming a layer of the slurry may comprise spraying, casting or extruding the slurry, for example. In some cases, the layer is formed by electro-spraying the slurry. In some cases, the layer is formed by casting the slurry.

In some cases, the slurry is applied to a carrier.

In some cases, the steps (b) and/or (c) and/or (d) may, at least partially, occur simultaneously (for example, during electro-spraying). In some cases, these steps may occur sequentially.

The step (c) of setting the gel may comprise the addition of a setting agent to the slurry. For example, the slurry may comprise sodium, potassium or ammonium alginate as a gel-precursor, and a setting agent comprising a calcium source (such as calcium chloride), may be added to the slurry to form a calcium alginate gel.

The total amount of the setting agent, such as a calcium source, may be 0.5-5 wt % (calculated on a dry weight basis). The inventors have found that the addition of too little setting agent may result in an amorphous solid which does not stabilise the amorphous solid components and results in these components dropping out of the amorphous solid. The inventors have found that the addition of too much setting agent results in an amorphous solid that is very tacky and consequently has poor handleability.

Alginate salts are derivatives of alginic acid and are typically high molecular weight polymers (10-600 kDa). Alginic acid is a copolymer of β-D-mannuronic (M) and α-L-guluronic acid (G) units (blocks) linked together with (1,4)-glycosidic bonds to form a polysaccharide. On addition of calcium cations, the alginate crosslinks to form a gel. The inventors have determined that alginate salts with a high G monomer content more readily form a gel on addition of the calcium source. In some cases therefore, the gel-precursor pay comprise an alginate salt in which at least about 40%, 45%, 50%, 55%, 60% or 70% of the monomer units in the alginate copolymer are α-L-guluronic acid (G) units.

The drying step may cause the cast material thickness to reduce by at least 80%, suitably 85% or 87%. For instance, the slurry may be cast at a thickness of 2 mm, and the resulting dried amorphous solid material may have a thickness of 0.2 mm.

In some cases, the amorphous solid may have a thickness of about 0.015 mm to about 1.0 mm. Suitably, the thickness may be in the range of about 0.05 mm, 0.1 mm or 0.15 mm to about 0.5 mm or 0.3 mm. The inventors have found that a material having a thickness of 0.2 mm is particularly suitable. The amorphous solid may comprise more than one layer, and the thickness described herein refers to the aggregate thickness of those layers.

In some cases, the slurry solvent may consist essentially of or consist of water. In some cases, the slurry may comprise from about 50 wt %, 60 wt %, 70 wt %, 80 wt % or 90 wt % of solvent (WWB).

In cases where the solvent consists of water, the dry weight content of the slurry may match the dry weight content of the amorphous solid. Thus, the discussion herein relating to the solid composition is explicitly disclosed in combination with the slurry aspect of the invention.

In some examples, the slurry has a viscosity of from about 10 to about 20 Pa·s at 46.5° C., such as from about 14 to about 16 Pa·s at 46.5° C.

The aerosolisable material comprising the amorphous solid may have any suitable area density, such as from 30 $g/m^2$ to 120 $g/m^2$. In some embodiments, aerosolisable material may have an area density of from about 30 to 70 $g/m^2$, or about to 60 $g/m^2$. In some embodiments, the amorphous solid may have an area density of from about 80 to 120 $g/m^2$, or from about 70 to 110 $g/m^2$, or particularly from about 90 to 110 $g/m^2$. Such area densities may be particularly suitable where the aerosol-generating material is included in a consumable or system in sheet form, or as a shredded sheet (described further hereinbelow).

In some examples, the amorphous solid in sheet form may have a tensile strength of from around 200 N/m to around 900 N/m. In some examples, such as where the amorphous solid does not comprise a filler, the amorphous solid may have a tensile strength of from 200 N/m to 400 N/m, or 200 N/m to 300 N/m, or about 250 N/m. Such tensile strengths may be particularly suitable for embodiments wherein the aerosolisable material is formed as a sheet and then shredded and incorporated into a consumable. In some examples, such as where the amorphous solid comprises a filler, the amorphous solid may have a tensile strength of from 600 N/m to 900 N/m, or from 700 N/m to 900 N/m, or around 800 N/m. Such tensile strengths may be particularly suitable for embodiments wherein the aerosolisable material is included in a consumable or system as a rolled sheet, suitably in the form of a tube In one particular case, the carrier may be a paper-backed foil; the paper layer abuts the amorphous solid layer and the properties discussed in the previous paragraphs are afforded by this abutment. The foil backing is substantially impermeable, providing control of the aerosol flow path. A metal foil backing may also serve to conduct heat to the amorphous solid.

In another case, the foil layer of the paper-backed foil abuts the amorphous solid. The foil is substantially impermeable, thereby preventing water provided in the amorphous solid to be absorbed into the paper which could weaken its structural integrity.

In some cases, the carrier is formed from or comprises metal foil, such as aluminium foil. A metallic carrier may allow for better conduction of thermal energy to the amorphous solid. Additionally, or alternatively, a metal foil may function as a susceptor in an induction heating system. In particular embodiments, the carrier comprises a metal foil layer and a support layer, such as cardboard. In these embodiments, the metal foil layer may have a thickness of less than 20 μm, such as from about 1 μm to about 10 μm, suitably about 5 μm.

The active substance as used herein may be a physiologically active material, which is a material intended to achieve or enhance a physiological response. The active substance may for example be selected from nutraceuticals, nootropics, psychoactives. The active substance may be naturally occurring or synthetically obtained. The active substance may comprise for example nicotine, caffeine, taurine, theine, vitamins such as B6 or B12 or C, melatonin, cannabinoids, or constituents, derivatives, or combinations thereof. The active substance may comprise one or more constituents, derivatives or extracts of tobacco, cannabis or another botanical.

In some embodiments, the active substance comprises nicotine.

In some embodiments, the active substance comprises caffeine, melatonin or vitamin B12.

As noted herein, the active substance may comprise one or more constituents, derivatives or extracts of cannabis, such as one or more cannabinoids or terpenes.

Cannabinoids are a class of natural or synthetic chemical compounds which act on cannabinoid receptors (i.e., CB1 and CB2) in cells that repress neurotransmitter release in the brain. Cannabinoids may be naturally occurring (phytocannabinoids) from plants such as cannabis, from animals (endocannabinoids), or artificially manufactured (synthetic cannabinoids). Cannabis species express at least 85 different phytocannabinoids, and are divided into subclasses, including cannabigerols, cannabichromenes, cannabidiols, tetrahydrocannabinols, cannabinols and cannabinodiols, and other cannabinoids. Cannabinoids found in cannabis include, without limitation: cannabigerol (CBG), cannabichromene (CBC), cannabidiol (CBD), tetrahydrocannabinol (THC), cannabinol (CBN), cannabinodiol (CBDL), cannabicyclol (CBL), cannabivarin (CBV), tetrahydrocannabivarin (THCV), cannabidivarin (CBDV), cannabichromevarin (CBCV), cannabigerovarin (CBGV), cannabigerol monomethyl ether (CBGM), cannabinerolic acid, cannabidiolic acid (CBDA), Cannabinol propyl variant (CBNV), cannabitriol (CBO), tetrahydrocannabmolic acid (THCA), and tetrahydrocannabivarinic acid (THCV A).

As noted herein, the active substance may comprise or be derived from one or more botanicals or constituents, derivatives or extracts thereof. As used herein, the term "botanical" includes any material derived from plants including, but not limited to, extracts, leaves, bark, fibres, stems, roots, seeds, flowers, fruits, pollen, husk, shells or the like. Alternatively, the material may comprise an active compound naturally existing in a botanical, obtained synthetically. The material may be in the form of liquid, gas, solid, powder, dust, crushed particles, granules, pellets, shreds, strips, sheets, or the like. Example botanicals are tobacco, eucalyptus, star anise, hemp, cocoa, cannabis, fennel, lemongrass, peppermint, spearmint, rooibos, chamomile, flax, ginger, *Ginkgo biloba*, hazel, hibiscus, laurel, licorice (liquorice), matcha, mate, orange skin, papaya, rose, sage, tea such as green tea or black tea, thyme, clove, cinnamon, coffee, aniseed (anise), basil, bay leaves, cardamom, coriander, cumin, nutmeg, oregano, paprika, rosemary, saffron, lavender, lemon peel, mint, juniper, elderflower, vanilla, wintergreen, beefsteak plant, curcuma, turmeric, sandalwood, cilantro, bergamot, orange blossom, myrtle, cassis, valerian, pimento, mace, damien, marjoram, olive, lemon balm, lemon basil, chive, carvi, verbena, tarragon, geranium, mulberry, ginseng, theanine, theacrine, maca, ashwagandha, damiana, guarana, chlorophyll, baobab or any combination thereof. The mint may be chosen from the following mint varieties: *Mentha arvensis, Mentha* c.v., *Mentha niliaca, Mentha piperita, Mentha piperita citrata* c.v., *Mentha piperita* c.v., *Mentha*

*spicata crispa, Mentha cordifolia, Mentha longifolia, Mentha suaveolens variegata, Mentha pulegium, Mentha spicata* c.v. and *Mentha suaveolens*.

In some embodiments, the botanical is selected from eucalyptus, star anise, cocoa and hemp.

In some embodiments, the botanical is selected from rooibos and fennel.

As used herein, the terms "flavour" and "flavourant" refer to materials which, where local regulations permit, may be used to create a desired taste, aroma or other somatosensorial sensation in a product for adult consumers.

They may include naturally occurring flavour materials, botanicals, extracts of botanicals, synthetically obtained materials, or combinations thereof (e.g., tobacco, cannabis, licorice (liquorice), hydrangea, eugenol, Japanese white bark magnolia leaf, chamomile, fenugreek, clove, maple, matcha, menthol, Japanese mint, aniseed (anise), cinnamon, turmeric, Indian spices, Asian spices, herb, wintergreen, cherry, berry, red berry, cranberry, peach, apple, orange, mango, clementine, lemon, lime, tropical fruit, papaya, rhubarb, grape, durian, dragon fruit, cucumber, blueberry, mulberry, citrus fruits, Drambuie, bourbon, scotch, whiskey, gin, tequila, rum, spearmint, peppermint, lavender, aloe vera, cardamom, celery, cascarilla, nutmeg, sandalwood, bergamot, geranium, khat, naswar, betel, shisha, pine, honey essence, rose oil, vanilla, lemon oil, orange oil, orange blossom, cherry blossom, cassia, caraway, cognac, jasmine, ylang-ylang, sage, fennel, wasabi, piment, ginger, coriander, coffee, hemp, a mint oil from any species of the genus *Mentha*, eucalyptus, star anise, cocoa, lemongrass, rooibos, flax, *Ginkgo biloba*, hazel, hibiscus, laurel, mate, orange skin, rose, tea such as green tea or black tea, thyme, juniper, elderflower, basil, bay leaves, cumin, oregano, paprika, rosemary, saffron, lemon peel, mint, beefsteak plant, curcuma, cilantro, myrtle, cassis, valerian, pimento, mace, damien, marjoram, olive, lemon balm, lemon basil, chive, carvi, verbena, tarragon, limonene, thymol, camphene), flavour enhancers, bitterness receptor site blockers, sensorial receptor site activators or stimulators, sugars and/or sugar substitutes (e.g., sucralose, acesulfame potassium, aspartame, saccharine, cyclamates, lactose, sucrose, glucose, fructose, sorbitol, or mannitol), and other additives such as charcoal, chlorophyll, minerals, botanicals, or breath freshening agents. They may be imitation, synthetic or natural ingredients or blends thereof. They may be in any suitable form, for example, liquid such as an oil, solid such as a powder, or gas.

The flavour may suitably comprise one or more mint-flavours suitably a mint oil from any species of the genus *Mentha*. The flavour may suitably comprise, consist essentially of or consist of menthol.

In some embodiments, the flavour comprises menthol, spearmint and/or peppermint.

In some embodiments, the flavour comprises flavour components of cucumber, blueberry, citrus fruits and/or redberry.

In some embodiments, the flavour comprises eugenol.

In some embodiments, the flavour comprises flavour components extracted from tobacco.

In some embodiments, the flavour comprises flavour components extracted from cannabis.

In some embodiments, the flavour may comprise a sensate, which is intended to achieve a somatosensorial sensation which are usually chemically induced and perceived by the stimulation of the fifth cranial nerve (trigeminal nerve), in addition to or in place of aroma or taste nerves, and these may include agents providing heating, cooling, tingling, numbing effect. A suitable heat effect agent may be, but is not limited to, vanillyl ethyl ether and a suitable cooling agent may be, but not limited to eucalyptol, WS-3.

As used herein, the term "aerosol generating agent" refers to an agent that promotes the generation of an aerosol. An aerosol generating agent may promote the generation of an aerosol by promoting an initial vaporisation and/or the condensation of a gas to an inhalable solid and/or liquid aerosol.

Suitable aerosol generating agents include, but are not limited to: a polyol such as erythritol, sorbitol, glycerol, and glycols like propylene glycol or triethylene glycol; a non-polyol such as monohydric alcohols, high boiling point hydrocarbons, acids such as lactic acid, glycerol derivatives, esters such as diacetin, triacetin, triethylene glycol diacetate, triethyl citrate or myristates including ethyl myristate and isopropyl myristate and aliphatic carboxylic acid esters such as methyl stearate, dimethyl dodecanedioate and dimethyl tetradecanedioate. The aerosol generating agent may suitably have a composition that does not dissolve menthol. The aerosol generating agent may suitably comprise, consist essentially of or consist of glycerol.

As used herein, the term "tobacco material" refers to any material comprising tobacco or derivatives therefore. The term "tobacco material" may include one or more of tobacco, tobacco derivatives, expanded tobacco, reconstituted tobacco or tobacco substitutes. The tobacco material may comprise one or more of ground tobacco, tobacco fibre, cut tobacco, extruded tobacco, tobacco stem, reconstituted tobacco and/or tobacco extract.

The tobacco used to produce tobacco material may be any suitable tobacco, such as single grades or blends, cut rag or whole leaf, including Virginia and/or Burley and/or Oriental. It may also be tobacco particle 'fines' or dust, expanded tobacco, stems, expanded stems, and other processed stem materials, such as cut rolled stems. The tobacco material may be a ground tobacco or a reconstituted tobacco material. The reconstituted tobacco material may comprise tobacco fibres, and may be formed by casting, a Fourdrinier-based paper making-type approach with back addition of tobacco extract, or by extrusion.

In some embodiments, the amorphous solid comprises menthol.

Particular embodiments comprising a menthol-containing amorphous solid may be particularly suitable for including in a consumable or system as a shredded sheet. In these embodiments, the amorphous solid may have the following composition (DWB): gelling agent (preferably comprising alginate, more preferably comprising a combination of alginate and pectin) in an amount of from about 20 wt % to about 40 wt %, or about 25 wt % to 35 wt %; menthol in an amount of from about 35 wt % to about 60 wt %, or from about 40 wt % to 55 wt %; aerosol generating agent (preferably comprising glycerol) in an amount of from about 10 wt % to about 30 wt %, or from about 15 wt % to about 25 wt % (DWB).

In one embodiment, the amorphous solid comprises about 32-33 wt % of an alginate/pectin gelling agent blend; about 47-48 wt % menthol flavourant; and about 19-20 wt % glycerol aerosol generating agent (DWB).

As noted above, the amorphous solid of these embodiments may be included in a consumable or system as a shredded sheet. The shredded sheet may be provided in the consumable or system blended with cut tobacco. Alternatively, the amorphous solid may be provided as a non-shredded sheet. Suitably, the shredded or non-shredded sheet has a thickness of from about 0.015 mm to about 1 mm, preferably from about 0.02 mm to about 0.07 mm.

Particular embodiments of the menthol-containing amorphous solid may be particularly suitable for including in a consumable or system as a sheet, such as a sheet circumscribing a rod of aerosolisable material (e.g. tobacco). In these embodiments, the amorphous solid may have the following composition (DWB): gelling agent (preferably comprising alginate, more preferably comprising a combination of alginate and pectin) in an amount of from about 5 wt % to about 40 wt %, or about 10 wt % to 30 wt %; menthol in an amount of from about 10 wt % to about 50 wt %, or from about 15 wt % to 40 wt %; aerosol generating agent (preferably comprising glycerol) in an amount of from about 5 wt % to about 40 wt %, or from about 10 wt % to about 35 wt %; and optionally filler in an amount of up to 60 wt %—for example, in an amount of from 5 wt % to 20 wt %, or from about 40 wt % to 60 wt % (DWB).

In one of these embodiments, the amorphous solid comprises about 11 wt % of an alginate/pectin gelling agent blend, about 56 wt % woodpulp filler, about 18% menthol flavourant and about 15 wt % glycerol (DWB).

In another of these embodiments, the amorphous solid comprises about 22 wt % of an alginate/pectin gelling agent blend, about 12 wt % woodpulp filler, about 36% menthol flavourant and about 30 wt % glycerol (DWB).

As noted above, the amorphous solid of these embodiments may be included as a sheet. In one embodiment, the sheet is provided on a carrier comprising paper. In one embodiment, the sheet is provided on a carrier comprising metal foil, suitably aluminium metal foil. In this embodiment, the amorphous solid may abut the metal foil.

In one embodiment, the sheet forms part of a laminate material with a layer (preferably comprising paper) attached to a top and bottom surface of the sheet. Suitably, the sheet of amorphous solid has a thickness of from about 0.015 mm to about 1 mm.

In some embodiments, the amorphous solid comprises a flavourant which does not comprise menthol. In these embodiments, the amorphous solid may have the following composition (DWB): gelling agent (preferably comprising alginate) in an amount of from about 5 to about 40 wt %, or from about 10 wt % to about 35 wt %, or from about 20 wt % to about 35 wt %; flavourant in an amount of from about 0.1 wt % to about 40 wt %, of from about 1 wt % to about 30 wt %, or from about 1 wt % to about 20 wt %, or from about 5 wt % to about 20 wt %; aerosol generating agent (preferably comprising glycerol) in an amount of from 15 wt % to 75 wt %, or from about 30 wt % to about 70 wt %, or from about 50 wt % to about 65 wt %; and optionally filler (suitably woodpulp) in an amount of less than about 60 wt %, or about 20 wt %, or about 10 wt %, or about 5 wt % (preferably the amorphous solid does not comprise filler) (DWB).

In one of these embodiments, the amorphous solid comprises about 27 wt % alginate gelling agent, about 14 wt % flavourant and about 57 wt % glycerol aerosol generating agent (DWB).

In another of these embodiments, the amorphous solid comprises about 29 wt % alginate gelling agent, about 9 wt % flavourant and about 60 wt % glycerol (DWB).

The amorphous solid of these embodiments may be included in a consumable or system as a shredded sheet, optionally blended with cut tobacco. Alternatively, the amorphous solid of these embodiments may be included in a consumable or system as a sheet, such as a sheet circumscribing a rod of aerosolisable material (e.g. tobacco). Alternatively, the amorphous solid of these embodiments may be included in a consumable or system as a layer portion disposed on a carrier.

In some embodiments, the amorphous solid comprises tobacco extract. In these embodiments, the amorphous solid may have the following composition (DWB): gelling agent (preferably comprising alginate) in an amount of from about 5 wt % to about 40 wt %, or about 10 wt % to 30 wt %, or about 15 wt % to about 25 wt %; tobacco extract in an amount of from about 30 wt % to about 60 wt %, or from about 40 wt % to 55 wt %, or from about 45 wt % to about 50 wt %; aerosol generating agent (preferably comprising glycerol) in an amount of from about 10 wt % to about 50 wt %, or from about 20 wt % to about 40 wt %, or from about 25 wt % to about 35 wt % (DWB).

In one embodiment, the amorphous solid comprises about 20 wt % alginate gelling agent, about 48 wt % Virginia tobacco extract and about 32 wt % glycerol (DWB).

The amorphous solid of these embodiments may have any suitable water content. For example, the amorphous solid may have a water content of from about 5 wt % to about 15 wt %, or from about 7 wt % to about 13 wt %, or about 10 wt %.

The amorphous solid of these embodiments may be included in a consumable or system as a shredded sheet, optionally blended with cut tobacco. Alternatively, the amorphous solid of these embodiments may be included in a consumable or system as a sheet, such as a sheet circumscribing a rod of aerosolisable material (e.g. tobacco). Alternatively, the amorphous solid of these embodiments may be included in a consumable or system as a layer portion disposed on a carrier. Suitably, in any of these embodiments, the amorphous solid has a thickness of from about 50 μm to about 200 μm, or about 50 μm to about 100 μm, or about 60 μm to about 90 μm, suitably about 77 μm.

The slurry for forming this amorphous solid may also form part of the invention. In some cases, the slurry may have an elastic modulus of from about 5 to 1200 Pa (also referred to as storage modulus); in some cases, the slurry may have a viscous modulus of about 5 to 600 Pa (also referred to as loss modulus).

All percentages by weight described herein (denoted wt %) are calculated on a dry weight basis, unless explicitly stated otherwise. All weight ratios are also calculated on a dry weight basis. A weight quoted on a dry weight basis refers to the whole of the extract or slurry or material, other than the water, and may include components which by themselves are liquid at room temperature and pressure, such as glycerol. Conversely, a weight percentage quoted on a wet weight basis refers to all components, including water.

As used herein, the term "sheet" denotes an element having a width and length substantially greater than a thickness thereof. The sheet may be a strip, for example.

As used herein, the term "heating material" or "heater material" refers to material that is heatable by penetration with a varying magnetic field.

Induction heating is a process in which an electrically-conductive object is heated by penetrating the object with a varying magnetic field. The process is described by Faraday's law of induction and Ohm's law. An induction heater may comprise an electromagnet and a device for passing a varying electrical current, such as an alternating current, through the electromagnet. When the electromagnet and the object to be heated are suitably relatively positioned so that the resultant varying magnetic field produced by the electromagnet penetrates the object, one or more eddy currents are generated inside the object. The object has a resistance to the flow of electrical currents. Therefore, when such eddy currents are generated in the object, their flow against the electrical resistance of the object causes the object to be heated. This process is called Joule, ohmic, or resistive heating. An object that is capable of being inductively heated is known as a susceptor.

It has been found that, when the susceptor is in the form of a closed electrical circuit, magnetic coupling between the susceptor and the electromagnet in use is enhanced, which results in greater or improved Joule heating.

Magnetic hysteresis heating is a process in which an object made of a magnetic material is heated by penetrating the object with a varying magnetic field. A magnetic material can be considered to comprise many atomic-scale magnets, or magnetic dipoles. When a magnetic field penetrates such material, the magnetic dipoles align with the magnetic field. Therefore, when a varying magnetic field, such as an alternating magnetic field, for example as produced by an electromagnet, penetrates the magnetic material, the orientation of the magnetic dipoles changes with the varying applied magnetic field. Such magnetic dipole reorientation causes heat to be generated in the magnetic material.

When an object is both electrically-conductive and magnetic, penetrating the object with a varying magnetic field can cause both Joule heating and magnetic hysteresis heating in the object. Moreover, the use of magnetic material can strengthen the magnetic field, which can intensify the Joule and magnetic hysteresis heating.

In each of the above processes, as heat is generated inside the object itself, rather than by an external heat source by heat conduction, a rapid temperature rise in the object and more uniform heat distribution can be achieved, particularly through selection of suitable object material and geometry, and suitable varying magnetic field magnitude and orientation relative to the object. Moreover, as induction heating and magnetic hysteresis heating do not require a physical connection to be provided between the source of the varying magnetic field and the object, design freedom and control over the heating profile may be greater, and cost may be lower.

Figure 2:
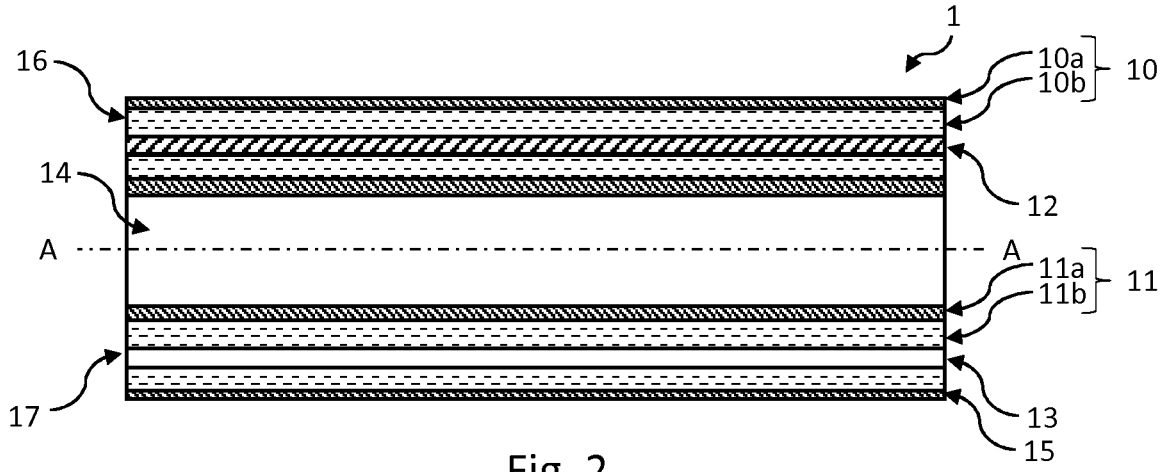
FIG. 2 shows a schematic cross-sectional side view of the consumable of FIG. 1 taken along the line II-II in FIG. 1.

Referring to FIGS. 1 and 2, there are shown schematic cross-sectional end and side views of an example of a consumable according to an embodiment of the invention. The consumable 1 is for use with apparatus for heating aerosolisable material to volatilise at least one component of the aerosolisable material, such as the apparatus 100 shown in FIG. 6 and described below. The apparatus may be a tobacco heating product (also known in the art as a tobacco heating device or a heat-not-burn device).

The consumable 1 comprises an outer tube 10, an inner member 11 inside the outer tube 10, and plural supports 12. The supports 12 support the inner member 11 relative to the outer tube 10 so that plural air gaps 13 exist between the inner member 11 and the outer tube 10. The supports 12 connect the inner member 11 to the outer tube 10. In this embodiment, the inner member 11 comprises a hollow inner tube 11 that defines a passageway 14 therein, but in other embodiments the inner member 11 may be other than tubular, such as solid rod-shaped.

The consumable 1 of this embodiment has circular inner and outer cross-sectional shapes. Moreover, the inner member 11 and the outer tube 10 are both circular. In other embodiments, one or each of the inner member 11 and the outer tube 10 is non-circular, such as elliptical, polygonal, rectangular, square, triangular, or star-shaped. In some embodiments, the inner member 11 and/or the outer tube 10 is corrugated.

The consumable 1 of this embodiment extends along an axis A-A. The axis A-A is a central axis that extends along the passageway 14, but in other embodiments the configuration of the consumable may be such that the axis A-A is offset from the passageway 14. In this embodiment, the consumable 1 is elongate in the direction of the axis A-A, but in other embodiments a width or diameter of the consumable 1 may be greater than or equal to a dimension of the consumable 1 in the direction of the axis A-A, so that the consumable 1 is not elongate. In this embodiment, the inner member 11 and the outer tube 10 are substantially concentric, each with a centre that lies on the axis A-A. In other embodiments, the inner member 11 may be non-concentric with the outer tube 10, and the centre of one or each of the inner member 11 and the outer tube 10 may be spaced from the axis A-A.

In this embodiment, the consumable 1 comprises three supports 12 that support the inner member 11 relative to the outer tube 10. In some embodiments, the consumable may comprise more than or fewer than three supports 12, such as four, five or six supports 12, only two supports 12, or only one support 12.

In this embodiment, the supports 12 are located between the inner member 11 and the outer tube 10 and are circumferentially spaced apart from each other by the air gaps 13, but in other embodiments this may not be the case. For example, in some embodiments, a support 12 may be located abutting axial end faces of the inner member 11 and the outer tube 10, or two supports 12 may be located at respective axial ends of the inner member 11 and the outer tube 10. Such support(s) 12 may be end pieces. These may be made of any suitable material, such as a plastics material. The end pieces may have features for receiving the inner member 11 and the outer tube 10, respectively, and be configured to hold the inner member 11 relative to the outer tube 10.

In some embodiments, the support(s) 12 may be omitted. For example, the inner member 11 and/or the outer tube 10 may be shaped so that the inner member 11 and the outer tube 10 contact each other in at least one location. For example, the inner member 11 and/or the outer tube 10 may be corrugated. Therefore, the inner member 11 and the outer tube 10 themselves are configured to support the inner member 11 relative to the outer tube 10 without the provision of any further support 12. In such embodiments, at least part of the inner member 11 is spaced from the outer tube 10 by an air gap 13. In some such embodiments, plural parts of the inner member 11 are spaced from the outer tube 10 by respective air gaps 13.

In this embodiment, the air gaps 13 are circumferentially spaced apart and are separated by the supports 12. In this embodiment, there are three air gaps 13. In other embodiments, the consumable 1 may comprise more than or fewer than three air gaps 13, such as four, five or six air gaps 13, only two air gaps 13, or only one air gap 13. In some embodiments, the number of air gap(s) 13 equals the number of support(s) 12 located between the inner member 11 and the outer tube 10.

The supports 12 radiate from the inner member 11 to the outer tube 10, so that each of the supports 12 extends in a generally radial direction that is perpendicular to the axis A-A of the consumable 1. Each of the supports 12 may take the form of a spoke or a fin. In this embodiment, each of the supports 12 is substantially planar. In other embodiments, the supports 12 may extend from the inner member 11 to the outer tube 10 in other than a radial direction and/or may be non-planar, such as curved or corrugated.

Figure 3:
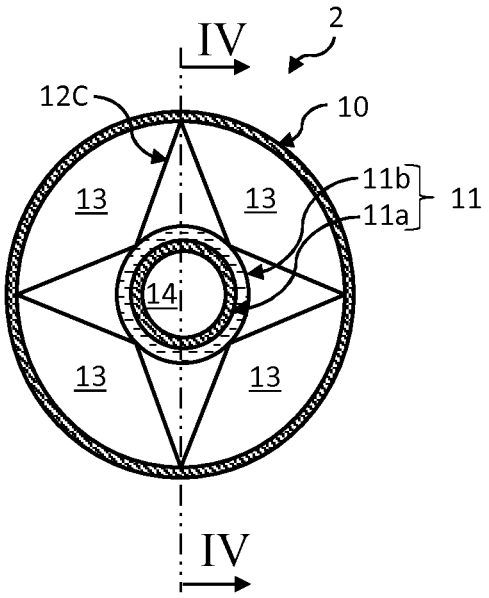
FIG. 3 shows a schematic cross-sectional end view of an example of another consumable for use with apparatus for heating aerosolisable material to volatilise at least one component of the aerosolisable material.
Figure 4:
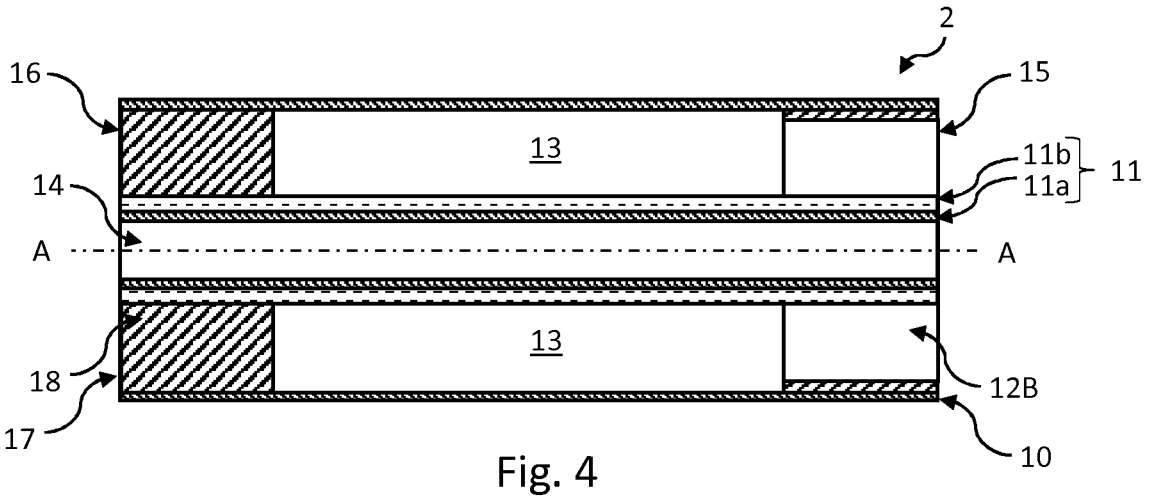
FIG. 4 shows a schematic cross-sectional side view of the consumable of FIG. 3 taken along the line IV-IV in FIG. 3.

In some embodiments, such as that shown in FIGS. 3 and 4, the or each support 12 comprises an annular non-circular support 12C between the inner member 11 and the outer tube 10. FIGS. 3 and 4 show schematic cross-sectional end and side views of an example of another consumable according to an embodiment of the invention. The consumable 2 of FIGS. 3 and 4 is for use with apparatus for heating aerosolisable material to volatilise at least one component of the aerosolisable material, such as the apparatus 100 shown in FIG. 6 and described below. In the consumable 2 of FIGS. 3 and 4, the inner member 11 is as described above with reference to FIGS. 1 and 2, and so discussion thereof will be omitted for conciseness. The outer tube 10 in this embodiment is free of aerosolisable material, but in other embodiments the outer tube 10 may comprise aerosolisable material.

In contrast to the supports 12 of the consumable 1 of FIGS. 1 and 2, the consumable 2 of FIGS. 3 and 4 comprises a support 12C in the form of a folded or corrugated element 12C between the inner member 11 and the outer tube 10. The folded or corrugated element 12C may be made from any suitable material, such as paper, paperboard, card, cardboard, or a plastics material. In some embodiments, the support 12C of the consumable 2 comprises, or is made from, heating material, such as one of the heating materials discussed elsewhere herein. The support 12C is annular and thus extends fully around the inner member 11, but in other embodiments, the support 12C may be non-annular and thus extend only partially around the inner member 11.

In some embodiments, such as that shown in FIGS. 1 and 2, the or each support 12 extends along a full length or axial dimension of the outer tube 10, and optionally along a full length or axial dimension of the consumable 1, 2, 3. In other embodiments, such as that shown in FIGS. 3 and 4, the or each support 12C may extend along only a part of the outer tube 10 or the consumable 4. In use, in the embodiment of FIGS. 3 and 4, the support 12C is located only at an upstream end of the outer tube 10. In some embodiments, a plurality of spaced-apart supports 12 may be provided at respective intervals axially along the length or axial dimension of the outer tube 10 or the consumable 1, 2, 3.

The consumable 2 of FIGS. 3 and 4 comprises a porous filter 18 located at one end of the air gap 13. The filter 18 preferably comprises filtration material, such as cellulose acetate. In use, this filter 18 may be at a downstream end of the consumable 2 and be for filtering the aerosol generated within the air gap 13 in use. Such a filter 18 may be similarly provided in variations to other embodiments described herein.

In each of the embodiments of FIGS. 1 to 4, the inner tube 11 is located around the passageway 14, and the passageway 14 opens at an axial end 15 of the consumable 1, 2 so that a heating element of the apparatus is insertable into the passageway 14 in use, as will be discussed in more detail below. In each of the embodiments of FIGS. 1 to 4, the passageway 14 extends fully through the inner tube 11 from one axial end of the inner tube 11 to an opposite axial end of the inner tube 11. Moreover, in each of these embodiments, the passageway 14 extends fully through the consumable 1, 2 from a first axial end 15 of the consumable 1, 2 to an opposite second axial end 16 of the consumable 1, 2. However, in some embodiments, such as that shown in FIG. 5, the passageway 14 extends only partially along a length or axial dimension of the consumable, such as for a majority of the length or axial dimension of the consumable or for a minority of a length or axial dimension of the consumable.

Figure 5:
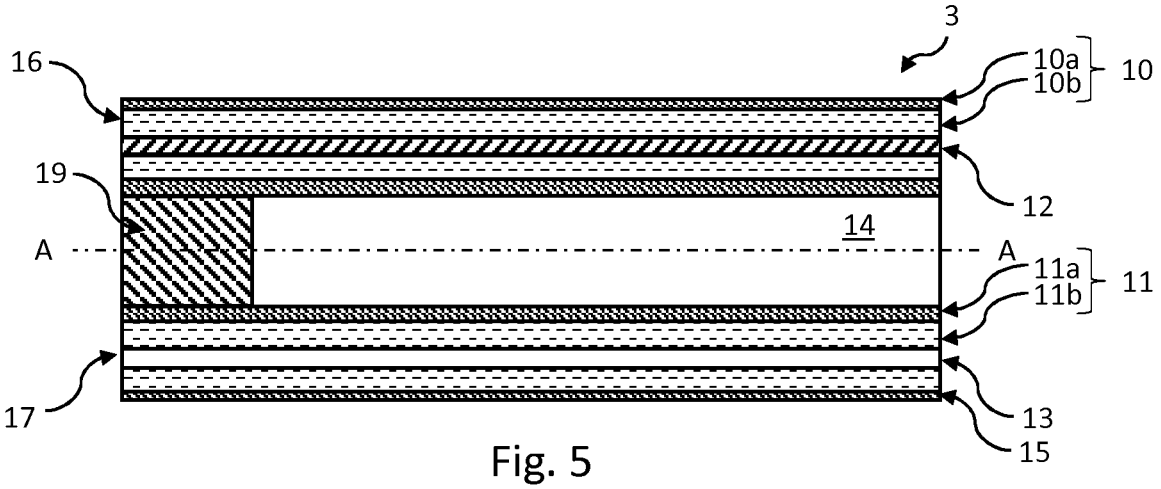
FIG. 5 shows a schematic cross-sectional side view of an example of a further consumable for use with apparatus for heating aerosolisable material to volatilise at least one component of the aerosolisable material.

FIG. 5 shows a schematic cross-sectional side view of an example of a further consumable according to an embodiment of the invention. The consumable 3 of FIG. 5 is for use with apparatus for heating aerosolisable material to volatilise at least one component of the aerosolisable material, such as the apparatus 100 shown in FIG. 6 and described below. The consumable 3 of FIG. 5 is identical to the consumable 1 of FIGS. 1 and 2, except that a body of material 19 is located radially inwardly of the inner tube 11 at the second axial end 16 of the consumable 3, so as to fill the inner hollow area of the inner tube 11 at the second axial end 16. The passageway 14 is thus a blind hole that extends for a distance from the first axial end of the consumable 3 to the body of material 19. In this embodiment, this distance is more than half of a length or axial dimension of the consumable 3, so that the passageway 14 extends for a majority of the length or axial dimension of the consumable 3. In other embodiments, the body of material 19 and the consumable 3 as a whole may be configured so that the passageway 14 extends only for, or less than, half of the length or axial dimension of the consumable 3. The body of material 19 may be porous or non-porous.

Each of the consumables 1, 2, 3 comprises aerosolisable material that is heatable to generate aerosol in the air gap(s) 13. In each embodiment, the aerosolisable material may, for example, comprise an amorphous solid or be in any of the other forms discussed herein.

In some embodiments, the inner member 11 comprises the aerosolisable material. In some such embodiments, a heating element for heating the aerosolisable material is insertable into the passageway 14 in use, and heating of the heating element causes heat energy to pass radially outwards from the heating element to the aerosolisable material of the adjacent inner member 11. The heat energy heats the aerosolisable material to volatilise at least one component of the aerosolisable material. The at least one component of the aerosolisable material then passes radially outwards from the inner member 11 to the air gap(s) 13. An aerosol may be formed in the inner member 11 or thereafter in the air gaps(s) 13, but in any event the heating of the inner member 11 causes the generation or provision of aerosol in the air gap(s) 13. Heating the consumable 1, 2, 3 from the inside outwards in this way can be more efficient than heating a consumable from the outside inwards, because heat from the internal heater of the apparatus can radiate only outwards.

In some embodiments, the outer tube 10 comprises aerosolisable material that is heatable to generate aerosol in the air gap(s) 13. In some such embodiments, a heating element for heating the aerosolisable material is locatable around and radially outwards of the outer tube 10, and heating of the heating element causes heat energy to pass radially inwards from the heating element to the aerosolisable material of the adjacent outer tube 10. The heat energy heats the aerosolisable material to volatilise at least one component of the aerosolisable material. The at least one component of the aerosolisable material then passes radially inwards from the outer tube 10 to the air gap(s) 13. Again, an aerosol may be formed in the outer tube 10 or thereafter in the air gaps(s) 13, but in any event the heating of the outer tube 10 causes the generation or provision of aerosol in the air gap(s) 13.

In some embodiments, each of the inner member 11 and the outer tube 10 comprises aerosolisable material that is heatable to generate aerosol in the air gap(s) 13. In some such embodiments, in use, a first heating element for heating the aerosolisable material of the inner member 11 is insertable into the passageway 14 as discussed above, and a second heating element for heating the aerosolisable material of the outer tube 10 is locatable around and radially outwards of the outer tube 10 as discussed above. The first and second heating elements may be independently controllable.

In some embodiments, the or each support 12 (when provided) comprises aerosolisable material that is heatable to generate aerosol in the air gap(s) 13. In some embodiments, in use, a heating element for heating the aerosolisable material of the support(s) 12 is insertable into the passageway 14 as discussed above and the heat energy from the heating element passes by heat conduction through the inner member 11 to the support(s) 12. In some embodiments, in use, a heating element for heating the aerosolisable material of the support(s) 12 is locatable around and radially outwards if the outer tube 10 as discussed above and the heat energy from the heating element passes by heat conduction through the outer tube 10 to the support(s) 12. In some such embodiments, the passageway 14 may be omitted. The conducted heat energy heats the aerosolisable material of the support(s) 12 to volatilise at least one component of the aerosolisable material. The at least one component of the aerosolisable material then passes, for example circumferentially, from the support(s) 12 to the air gap(s) 13. An aerosol may be formed in the support(s) 12 or thereafter in the air gaps(s) 13, but in any event the heating of the support(s) 12 causes the generation or provision of aerosol in the air gap(s) 13.

In some embodiments, the support(s) 12, and also one or each of the inner member 11 and the outer tube 10, comprises aerosolisable material that is heatable to generate aerosol in the air gap(s) 13.

In some embodiments, the support(s) 12 (when provided), the outer tube 10 or the inner member 11 consists of, or substantially consists of, aerosolisable material. For example, the support(s) 12 (when provided), the outer tube 10 or the inner member 11 may consist of reconstituted aerosolisable material, such as reconstituted tobacco. In some embodiments, the support(s) 12 (when provided), the outer tube 10 or the inner member 11 comprises a carrier and the aerosolisable material.

When the inner member 11 comprises aerosolisable material 11*b*, the aerosolisable material 11*b* of the inner member 11 may be radially outwards of the carrier 11*a* of the inner member 11 (see FIGS. 1 to 4). The aerosolisable material 11*b* of the inner member 11 may at least partially define the gap(s) 13. When the outer tube 10 comprises aerosolisable material 10*b*, the aerosolisable material 10*b* of the outer tube 10 may be radially inwards of the carrier 10*a* of the outer tube 10 (see FIGS. 1 and 2). The aerosolisable material 10*b* of the outer tube 10 may at least partially define the gap(s) 13. Such arrangements can help prevent contact between the aerosolisable material of the consumable and the apparatus or a user's fingers. When the or each support 12 comprises aerosolisable material 12*b*, the aerosolisable material 12*b* of the or each support 12 may be circumferentially adjacent the carrier 12*a* of the respective support 12 (see FIGS. 1 and 2). The aerosolisable material 12*b* of the support(s) 12 may at least partially define the gap(s) 13.

In some embodiments in which the inner member is corrugated, the corrugated inner member defines a plurality of troughs, and the aerosolisable material (such as an amorphous solid described herein) is disposed in at least one of the troughs, such as a plurality of the troughs.

In some embodiments in which the outer tube is corrugated, the corrugated outer tube defines a plurality of troughs, and the aerosolisable material (such as an amorphous solid described herein) is disposed in at least one of the troughs, such as a plurality of the troughs.

In some embodiments in which the support comprises a folded or corrugated element, the folded or corrugated element defines a plurality of troughs, and the aerosolisable material (such as an amorphous solid described herein) is disposed in at least one of the troughs, such as a plurality of the troughs.

In some embodiments, the carrier 11*a* (see FIGS. 1 to 4) of the inner member 11 and/or the carrier 10*a* of the outer tube 10 (see FIGS. 1 and 2) and/or the carrier 12*a* of the or each support 12 (when provided) (see FIGS. 1 and 2) consists of or comprises one or more materials selected from the group consisting of: paper, card, paperboard, cardboard, reconstituted tobacco, and a plastics material. In some embodiments, the carrier 10*a*, 11*a*, 12*a* of the inner member 11 and/or of the outer tube 10 and/or of the support 12 consists of or comprises heating material, such as one of the heating materials discussed elsewhere herein. The aerosolisable material 10*b*, 11*b*, 12*b* may be affixed to the carrier 10*a*, 11*a*, 12*a*. The affixing may be by any suitable mechanism, such as adhesion, coating, or co-extrusion. The coating may comprise spraying, electro-spraying, casting or band-casting, for example. The carrier 10*a*, 11*a*, 12*a* may be a laminate.

In one case, a surface of the carrier 10*a*, 11*a*, 12*a* that abuts the aerosolisable material 10*b*, 11*b*, 12*b* may be porous. For example, in some cases, the carrier 10*a*, 11*a*, 12*a* comprises paper. In some embodiments, the carrier 10*a*, 11*a*, 12*a* comprises or consists of a tobacco material, such as a sheet of reconstituted tobacco, which may be porous. The inventors have found that a porous carrier such as paper is particularly suitable for some embodiments of the present invention; the porous layer abuts the aerosolisable material 10*b*, 11*b*, 12*b* and forms a strong bond. The amorphous solid of the aerosolisable material 10*b*, 11*b*, 12*b* of some embodiments is formed by drying a gel and, without being limited by theory, it is thought that the slurry from which the gel is formed partially impregnates the porous carrier (e.g. paper) so that when the gel sets and forms cross-links, the carrier is partially bound into the gel. This provides a strong binding between the gel and the carrier (and between the dried gel and the carrier). The porous layer (e.g. paper) may also be used to carry flavours. In some cases, the porous layer may comprise paper, suitably having a porosity of 0-300 Coresta Units (CU), suitably 5-100 CU or 25-75 CU.

Additionally, surface roughness may contribute to the strength of bond between the aerosolisable material 10*b*, 11*b*, 12*b* and the carrier 10*a*, 11*a*, 12*a*. The inventors have found that the paper roughness (for the surface abutting the aerosolisable material) may suitably be in the range of 50-1000 Bekk seconds, suitably 50-150 Bekk seconds, suitably 100 Bekk seconds (measured over an air pressure interval of 50.66-48.00 kPa). (A Bekk smoothness tester is an instrument used to determine the smoothness of a paper surface, in which air at a specified pressure is leaked between a smooth glass surface and a paper sample, and the time (in seconds) for a fixed volume of air to seep between these surfaces is the "Bekk smoothness".)

In some embodiments, the aerosolisable material of the support(s) 12 has a different form or chemical composition to the aerosolisable material of the inner member 11 or of the outer tube 10. In some embodiments, the aerosolisable material of the outer tube 10 has a different form or chemical composition to the aerosolisable material of the inner member 11.

For example, in some embodiments, the difference in form may comprise a difference in mean particle size of the aerosolisable material. Typically, particles of aerosolisable material having a smaller mean particle size are heatable more quickly, for example to volatilise at least one component of the aerosolisable material, by a given heat source than are particles of the aerosolisable material having a greater mean particle size.

In some embodiments, the difference in form may comprise the aerosolisable material of one of the support(s) 12 (when provided), the outer tube 10 and the inner member 11 comprising reconstituted aerosolisable material (such as reconstituted tobacco) and the aerosolisable material of another one of the support(s) 12 (when provided), the outer tube 10 and the inner member 11 comprising an amorphous solid.

In some embodiments, the difference in chemical composition may comprise a difference in the ingredient or ingredients of the aerosolisable material, such as a difference in chemical compositions of respective amorphous solids. In some embodiments, the difference in chemical composition may comprise a difference in the type or density of aerosol forming agent, such as glycerol, in the aerosolisable material. In some embodiments, the difference in chemical composition may comprise a difference in quantities by weight of a smoke modifying agent, such as a flavourant as a percentage of a total weight of aerosolisable material.

In some embodiments, the support(s) 12 (when provided) and/or the outer tube 10 and/or the inner member 11 may comprise plural, spaced apart discrete regions of aerosolisable material. In use, such discrete regions of aerosolisable material may be heatable independently by respective heaters of an apparatus with which the consumable 1, 2, 3 is usable.

In some embodiments, each of the air gaps 13 extends fully along the outer tube 10 from one axial end of the outer tube 10 to an opposite axial end of the outer tube 10. Moreover, each of the air gaps 13 extends fully along the consumable 1, 2, 3 from the first axial end 15 of the consumable 1, 2, 3 to the opposite second axial end 16 of the consumable 1, 2, 3. In other embodiments, the or each or some of the air gaps 13 extends only partially along a length or axial dimension of the consumable 1, 2, 3, such as for a majority of the length or axial dimension of the consumable 1, 2, 3 or for a minority of a length or axial dimension of the consumable 1, 2, 3.

Each of the illustrated consumables 1, 2, 3 has at least one outlet 17 for permitting the aerosol to pass out of consumable 1, 2, 3 from the air gaps 13. In the embodiment of FIGS. 1 and 2, there are plural outlets 17, one corresponding to each of the air gaps 13. The outlets 17 of the consumable 1 are defined by the inner member 11 and the outer tube 10. In contrast, in the embodiment of FIGS. 3 and 4, the outlets 17 of the consumable 2 are defined by the porous filter 18, and more specifically by pores of the porous filter 18. In other embodiments, such as those in which there is only one air gap 13 between the inner member 11 and the outer tube 10, there may be only one outlet 17. The aerosol may pass out of the consumable 1, 2, 3 from the air gap(s) 13 via the outlet(s) 17, such as when a user draws on the consumable 1, 2, 3 or otherwise a negative pressure is applied to the consumable 1, 2, 3 to cause the movement of the aerosol out from the consumable 1, 2, 3.

In each of the illustrated embodiments, each of the outlets 17 is at an axial end 16 of the consumable 1, 2, 3. In the consumable 3 of FIG. 5, the passageway 14 opens at the first axial end 15 of the consumable 3, and each of the outlets 17 is at the second axial end 16 of the consumable 3 that is opposite from the first axial end 15 of the consumable 3. In some other embodiments, the outlet(s) 17 are at an axial end of the consumable and the passageway 14 opens at that same axial end of the consumable.

In some embodiments, the outer tube 10 forms at least part of a surface, such as an outermost surface, of the consumable 1, 2, 3. In some embodiments, the outer tube 10 forms at least a majority of the surface, such as all of the surface. In some embodiments, the inner tube 11 forms at least part of a surface, such as an innermost surface, of the consumable 1, 2, 3. In some embodiments, the inner tube 11 forms at least a majority of the surface, such as all of the surface.

Each of the inner member 11 and the outer tube 10 may be made of any suitable material. Each of the inner member 11 and the outer tube 10 should be sufficiently heat resistant to withstand temperatures to which it is subjected in normal use of the consumable 1, 2, 3, such as the temperatures discussed later herein. The inner member 11 and/or the outer tube 10 may help to provide the consumable 1, 2, 3 with rigidity. In some embodiments, the outer tube 10 is thicker than the inner tube 11, and in some other embodiments the outer tube 10 is thinner than the inner tube 11. In some embodiments, the inner member 11 and/or the outer tube 10 comprises one or more materials selected from the group consisting of: paper, card, paperboard, cardboard, reconstituted tobacco, and a plastics material. In some embodiments, the inner member 11 and/or the outer tube 10 comprises, or is made from, heating material, such as one of the heating materials discussed elsewhere herein. In some embodiments, the inner member 11 and/or the outer tube 10 may comprise a wound sheet or strip, for example of paper or card or reconstituted tobacco. In other embodiments, the inner member 11 and/or the outer tube 10 may comprise an extrudate, for example of a plastics material or a material comprising one or more metals or metal alloys. In some embodiments, the inner member 11 and the outer tube 10 may be extruded, such as co-extruded, and may be co-extruded with the support(s) 12 (when provided).

In some embodiments, the inner member 11 and/or the outer tube 10 is non-porous to aerosol generated from the aerosolisable material in use. This may help to prevent or discourage the generated aerosol from contacting the apparatus, or depositing in the apparatus, with which the consumable 1, 2, 3 is usable. It may also help to channel the flow of aerosol through the gap(s) 13 towards the outlet(s) 17.

The support(s) 12 (when provided) may be made of any suitable material. The or each support 12 should be sufficiently heat resistant to withstand temperatures to which it is subjected in normal use of the consumable 1, 2, 3, such as the temperatures discussed later herein. The or each support 12 may help to provide the consumable 1, 2, 3 with rigidity. In some embodiments, the or each support 12 comprises one or more materials selected from the group consisting of: paper, card, paperboard, cardboard, reconstituted tobacco, and a plastics material. In some embodiments, the or each support 12 comprises, or is made from, heating material, such as one of the heating materials discussed elsewhere herein.

In some embodiments, the outer tube 10 extends for a full length or axial dimension of the consumable 1, 2, 3. In other embodiments, the consumable 1, 2, 3 may comprise one or more elements (not shown) at one or each axial end of the outer tube 10, so that the outer tube 10 extends for only part of the length or axial dimension of the consumable 1, 2, 3.

In some embodiments, the consumable 1, 2, 3 comprises a porous body (not shown). The porous body may be for filtering aerosol or vapour released from the aerosolisable material in use. Alternatively, or additionally, the porous body may be for controlling the pressure drop over a length or axial dimension of the consumable 1, 2, 3. The porous body could be of any type used in the tobacco industry. For example, the porous body may be made of cellulose acetate. In some embodiments, the porous body is substantially cylindrical with a substantially circular cross section and a longitudinal axis. In other embodiments, the filter may have a different cross section or not be elongate.

In some embodiments, the porous body abuts an axial end 15, 16 of the outer tube 10 and is axially aligned with the outer tube 10. In other embodiments, the porous body may be spaced from the outer tube 10, such as by a gap and/or by one or more further components of the consumable 1, 2, 3. Example further component(s) are an additive or flavour source (such as an additive- or flavour-containing capsule or thread), which may be held by a body of filtration material or between two bodies of filtration material, for example.

The consumable 1, 2, 3 may also comprise a wrap that is wrapped around the outer tube 10 and the porous body to retain the porous body relative to the outer tube 10. The wrap may encircle the outer tube 10 and the porous body. The wrap may be wrapped around the outer tube 10 and the porous body so that free ends of the wrap overlap each other. The wrap may form part of, or all of, a circumferential outer surface of the consumable 1, 2, 3. The wrap could be made of any suitable material, such as paper, card, or reconstituted aerosolisable material (e.g. reconstituted tobacco). The wrap may also comprise an adhesive that adheres the overlapped free ends of the wrap to each other. The adhesive helps prevent the overlapped free ends of the wrap from separating. In other embodiments, the adhesive may be omitted or the wrap may take a different from to that described. In other embodiments, the porous body may be retained relative to the outer tube 10 by a connector other than a wrap, such as an adhesive.

In some embodiments, the consumable 1, 2, 3 has a length or an axial dimension of between 30 millimetres and 150 millimetres, such as between 70 millimetres and 120 millimetres.

In some embodiments, the consumable 1, 2, 3 has an inner dimension (e.g. an inner diameter) in a direction perpendicular to the axial direction of between 2 millimetres and 10 millimetres, such as between 4 millimetres and 8 millimetres.

In some embodiments, the consumable 1, 2, 3 has an outer dimension (e.g. an outer diameter) in a direction perpendicular to the axial direction of between 4 millimetres and 10 millimetres, such as between 4.5 millimetres and 8 millimetres.

In some embodiments, the aerosolisable material, wherever provided in the consumable 1, 2, 3, has a thickness of between 0.05 millimetres and 2 millimetres, such as between 0.05 millimetres and 1 millimetre, or such as between 0.1 millimetres and 1 millimetre, or such as between 0.15 millimetres and 0.5 millimetres. The thickness may be less than or equal to 1 millimetre, such as less than or equal to 0.5 millimetres, or less than or equal to 0.25 millimetres, or less than or equal to 0.2 millimetres, or less than or equal to 0.1 millimetres, or less than or equal to 0.05 millimetres.

In some embodiments, the outer tube 10 has a thickness of between 0.1 millimetres and 3 millimetres, such as between 0.15 millimetres and 2 millimetres.

In some embodiments, the inner tube 11 has a thickness of between 0.1 millimetres and 3 millimetres, such as between 0.15 millimetres and 2 millimetres.

Figure 6:
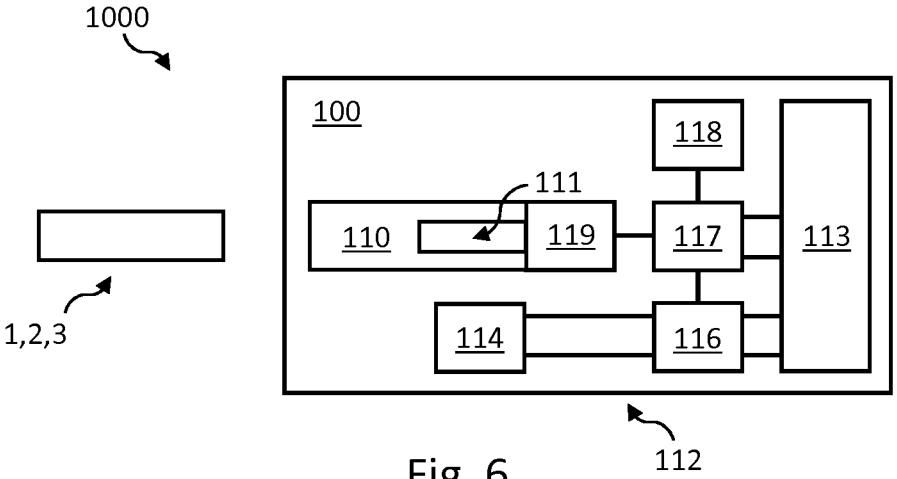
FIG. 6 shows a schematic cross-sectional side view of an example of a system comprising a consumable and apparatus for heating aerosolisable material of the consumable to volatilise at least one component of the aerosolisable material.

In some embodiments, the consumable 1, 2, 3 is suitable for insertion into a heating zone of an apparatus, such as the heating zone 110 of the apparatus 100 shown in FIG. 6, wherein the apparatus has a device for causing heating of the aerosolisable material of the consumable 1, 2, 3 when the consumable 1, 2, 3 is in the heating zone. Once in the heating zone 110, the device of the apparatus causes heating of the aerosolisable material to volatilise at least one component of the aerosolisable material.

In some embodiments, the device is configured to apply heat energy to the consumable 1, 2, 3, and specifically to the aerosolisable material via the outer tube 10 and/or the inner member 11. In some such embodiments, the device comprises a resistive heater that is heated by electrically connecting the resistive heater to a supply of electricity, and heat energy passes from the resistive heater to the consumable 1, 2, 3.

In some other embodiments, the device may comprise a magnetic field generator 112 for generating a varying magnetic field for penetrating the heating zone when the consumable 1, 2, 3 is in the heating zone 110, and the consumable 1, 2, 3 comprises heating material that is heatable by penetration with the varying magnetic field to thereby heat the aerosolisable material. Accordingly, in such embodiments, the device is configured to cause electromagnetic energy to be applied to the heating material of the consumable 1, 2, 3 to create heat in the heating material, and then heat energy is applied from the heating material to the aerosolisable material. In some embodiments, the consumable 1, 2, 3 may comprise heating material that is partially or fully embedded in the aerosolisable material.

In still further embodiments, the apparatus 100 has a heatable element comprising heating material, wherein the heatable element is in thermal contact with the heating zone, and wherein the magnetic field generator is for generating a varying magnetic field for penetrating the heatable element of the apparatus, so as to cause heating of the heatable element and thus the heating zone.

In any event, the volatilised component(s) of the aerosolisable material pass from the aerosolisable material and into the air gap(s) 13, and from there may pass out of the consumable 1, 2, 3 via the outlet(s) 17, such as by a user drawing on the consumable 1, 2, 3 or a mouthpiece (when provided) of the apparatus.

It will therefore be understood that, in some embodiments, the consumable 1, 2, 3 comprises heating material that is heatable by penetration with a varying magnetic field. The heating material may, for example, be any one or more of those discussed herein.

The outer tube 10 may comprise, consist of, or substantially consist of, heating material, or the outer tube 10 may be free from heating material. The inner member 11 may comprise, consist of, or substantially consist of, heating material, or the inner member 11 may be free from heating material. One or each of the support(s) 12 (when provided) may comprise, consist of, or substantially consist of, heating material, or may be free from heating material. It is preferable, though not essential, for the consumable 1, 2, 3 to comprise a closed circuit of heating material. The heating material may for example be any one or more of those discussed herein. In some embodiments, the consumable 1, 2, 3 may be free from heating material.

Referring to FIG. 6, there is shown a schematic cross-sectional side view of an example of a system comprising a consumable and apparatus for heating aerosolisable material of the consumable to volatilise at least one component of the aerosolisable material, according to an embodiment of the invention.

The system 1000 comprises the consumable 1 of FIGS. 1 and 2 and apparatus 100 for heating the aerosolisable material of the consumable 1 to volatilise at least one component of the aerosolisable material. In other embodiments, the consumable 1 may be replaced by any of the other consumables described herein, such as one of the consumables 2, 3 shown in FIGS. 3 to 5. In this embodiment, the apparatus 100 is a tobacco heating product (also known in the art as a tobacco heating device or a heat-not-burn device).

The apparatus comprises a heating zone 110 for receiving the consumable 1, 2, 3, and a device 112 for causing heating of the aerosolisable material when the consumable 1, 2, 3 is in the heating zone 110.

The apparatus 100 may define at least one air inlet (not shown) that fluidly connects the heating zone 110 with the exterior of the apparatus 100. A user may be able to inhale the volatilised component(s) of the aerosolisable material by drawing the volatilised component(s) from the heating zone 110. As the volatilised component(s) are removed from the heating zone 110 and the consumable 1, 2, 3, air may be drawn into the heating zone 110 via the air inlet(s) of the apparatus 100.

In this embodiment, the heating zone 110 comprises a recess for receiving at least a portion of the consumable 1, 2, 3. In other embodiments, the heating zone 110 may be other than a recess, such as a shelf, a surface, or a projection, and may require mechanical mating with the consumable 1, 2, 3 in order to co-operate with, or receive, the consumable 1, 2, 3. In this embodiment, the heating zone 110 is elongate, and is sized and shaped to accommodate the whole consumable 1, 2, 3. In other embodiments, the heating zone 110 may be dimensioned to receive only a portion of the consumable 1, 2, 3.

In some embodiments, the device 112 comprises an electrical power source, a resistive heater that is heated by passing electricity through the resistive heater, and a controller for controlling the passage of electricity through the resistive heater. The resistive heater is configured to apply heat energy to the heating zone 110, and thus to the consumable 1, 2, 3 when the consumable is in the heating zone 110. The resistive heater may cause the heat energy to be applied to the aerosolisable material in or via the outer tube 10 or the inner member 11. In some embodiments, the resistive heater may project into the heating zone 110 so as to be located in the passageway 14 of the consumable when the consumable is in the heating zone 110. For example, such a configuration may be used when the consumable is one of those of FIGS. 1 to 4. In some other embodiments, the resistive heater may be located radially outwards of the consumable when the consumable is in the heating zone 110. For example, the resistive heater may at least partially define the heating zone 110. Such a configuration may be used when the inner member 11 of the consumable does not define a passageway 14 therein. In some embodiments, the device may comprise a first resistive heater that is in the passageway 14 of the consumable when the consumable is in the heating zone 110, and a second resistive heater that is located radially outwards of the consumable when the consumable is in the heating zone 110.

In some embodiments, such as that shown in FIG. 6, the device 112 comprises a magnetic field generator for generating a varying magnetic field for penetrating the heating zone 110 when the consumable 1, 2, 3 is in the heating zone 110.

In some cases in use, substantially all of the amorphous solid is less than about 4 mm, 3 mm, 2 mm or 1 mm from the heater (i.e. the heatable element or the resistive heater). In some cases, the solid is disposed between about 0.010 mm and 2.0 mm from the heater, suitably between about 0.02 mm and 1.0 mm, suitably 0.1 mm to 0.5 mm. These minimum distances may, in some cases, reflect the thickness of a carrier that supports the amorphous solid. In some cases, a surface of the amorphous solid may directly abut the heater.

As discussed above, in some embodiments, the consumable comprises heating material for use in heating the aerosolisable material. In such embodiments, the magnetic field generator of the apparatus may be configured to generate a varying magnetic field that penetrates the heating material of the consumable 1, 2, 3 when the consumable 1, 2, 3 is in the heating zone 110.

In other embodiments, such as that shown in FIG. 6, the device 112 of the apparatus 100 comprises a heatable heating element 111 in the heating zone 110, and the magnetic field generator of the apparatus is configured to generate a varying magnetic field that penetrates the heating element 111. In some embodiments, the heating element is located radially outwards of the consumable 1, 2, 3 when the consumable 1, 2, 3 is in the heating zone 110. For example, the heating element may at least partially define the heating zone 110. In other embodiments, such as that shown in FIG. 6, the heating element 111 projects into the heating zone 110. Such a configuration is suitable when the inner member 11 of the consumable 1, 2, 3 comprises an inner tube that is located around a passageway 14 that opens at an axial end of the consumable 1, 2, 3, so that the heating element 111 is insertable into the passageway 14 of the consumable 1, 2, 3 in use. In some embodiments, such as that shown in FIG. 6, the heating element 111 enters the passageway 14 while the consumable 1, 2, 3 is inserted into the heating zone 110. In other embodiments the apparatus may be configured so that the heating element 111 is movable relative to the heating zone 110 so as to project into the passageway 14 when the consumable 1, 2, 3 is already located in the heating zone 110.

In some embodiments, the heating element 111 of the apparatus has an outer cross-sectional shape, and the inner tube 11 of the consumable 1, 2, 3 has an inner cross-sectional shape that matches the outer cross-sectional shape of the heating element 111. For example, the inner and outer cross-sectional shapes may be circular or may be non-circular, such as elliptical, polygonal, rectangular, square, triangular, corrugated, or star-shaped. In some embodiments, the heating element 111 of the apparatus and the inner tube 11 of the consumable 1, 2, 3 are relatively dimensioned so that the inner tube 11 abuts the heating element 111 in use, so as to increase the efficiency and effectiveness of heat energy transfer from the heating element 111 to the inner tube 11. The inner tube 11 may be a close fit to, or a snug fit on, the heating element 111.

In this embodiment, the magnetic field generator 112 comprises an electrical power source 113, a coil 114, a device 116 for passing a varying electrical current, such as an alternating current, through the coil 114, a controller 117, and a user interface 118 for user-operation of the controller 117.

The electrical power source 113 of this embodiment is a rechargeable battery. In other embodiments, the electrical power source 113 may be other than a rechargeable battery, such as a non-rechargeable battery, a capacitor, a battery-capacitor hybrid, or a connection to a mains electricity supply.

The coil 114 may take any suitable form. In some embodiments, the coil 114 is a helical coil of electrically-conductive material, such as copper. In some embodiments, the coil is a flat coil. That is, the coil may be a two-dimensional spiral of electrically-conductive material, such as copper. In some embodiments, the coil 114 encircles the heating zone 110. In some embodiments, the coil 114 extends along a longitudinal axis that is substantially aligned with a longitudinal axis of the heating zone 110. The aligned axes may be coincident. Alternatively, the aligned axes may be parallel or oblique to each other.

In this embodiment, the device 116 for passing a varying current through the coil 114 is electrically connected between the electrical power source 113 and the coil 114. In this embodiment, the controller 117 also is electrically connected to the electrical power source 113, and is communicatively connected to the device 116 to control the device 116. More specifically, in this embodiment, the controller 117 is for controlling the device 116, so as to control the supply of electrical power from the electrical power source 113 to the coil 114. In this embodiment, the controller 117 comprises an integrated circuit (IC), such as an IC on a printed circuit board (PCB). In other embodiments, the controller 117 may take a different form. In some embodiments, the apparatus 100 may have a single electrical or electronic component comprising the device 116 and the controller 117. The controller 117 is operated in this embodiment by user-operation of the user interface 118. The user interface 118 may comprise a push-button, a toggle switch, a dial, a touchscreen, or the like. In other embodiments, the user interface 118 may be remote and connected to the rest of the apparatus 100 wirelessly, such as via Bluetooth.

In this embodiment, operation of the user interface 118 by a user causes the controller 117 to cause the device 116 to cause an alternating electrical current to pass through the coil 114. This causes the coil 114 to generate an alternating magnetic field. The coil 114 and the heating zone 110 of the apparatus 100 are suitably relatively positioned so that, when the consumable 1, 2, 3 is located in the heating zone 110, the varying magnetic field produced by the coil 114 penetrates the heating element 111 of the apparatus 100. When the heating material of the heating element 111 is electrically-conductive, this penetration causes the generation of one or more eddy currents in the heating material. The flow of eddy currents in the heating material against the electrical resistance of the heating material causes the heating material to be heated by Joule heating. When the heating material of the heating element 111 is a magnetic material, the orientation of magnetic dipoles in the heating material changes with the changing applied magnetic field, which causes heat to be generated in the heating material.

In some embodiments, the consumable 1, 2, 3 comprises heating material and the coil 114 and the heating zone 110 of the apparatus 100 are suitably relatively positioned so that, when the consumable 1, 2, 3 is located in the heating zone 110, the varying magnetic field produced by the coil 114 penetrates the heating material of the consumable 1, 2, 3. In some embodiments, the apparatus 100 comprises the heating element 111, the heating element 111 comprises heating material, and the consumable 1, 2, 3 also comprises heating material. In some such embodiments, the coil 114 and the heating zone 110 of the apparatus 100 are suitably relatively positioned so that, when the consumable 1, 2, 3 is located in the heating zone 110, the varying magnetic field produced by the coil 114 penetrates the heating material of the consumable 1, 2, 3 and the heating material of the heating element 111.

The apparatus 100 of this embodiment comprises a temperature sensor 119 for sensing a temperature of the heating zone 110. The temperature sensor 119 is communicatively connected to the controller 117, so that the controller 117 is able to monitor the temperature of the heating zone 110. On the basis of one or more signals received from the temperature sensor 119, the controller 117 may cause the device 112 to adjust a characteristic of the varying or alternating electrical current passed through the coil 114 as necessary, in order to ensure that the temperature of the heating zone 110 remains within a predetermined temperature range. The characteristic may be, for example, amplitude or frequency or duty cycle. Within the predetermined temperature range, in use the aerosolisable material within a consumable located in the heating zone 110 is heated sufficiently to volatilise at least one component of the aerosolisable material 14 without combusting the aerosolisable material 14. Accordingly, the controller, and the apparatus 100 as a whole, is arranged to heat the aerosolisable material to volatilise the at least one component of the aerosolisable material without combusting the aerosolisable material. In some embodiments, the temperature range is about 50° C. to about 350° C., such as between about 100° C. and about 300° C., or between about 120° C. and about 350° C., or between about 140° C. and about 250° C., or between about 200° C. and about 270° C. In other embodiments, the temperature range may be other than one of these ranges. In some embodiments, the upper limit of the temperature range could be greater than 350° C. In some embodiments, the consumable may be non-combustible, for example in these ranges of temperatures. In some embodiments, the temperature sensor 119 may be omitted.

In some embodiments, the device 112 for causing heating of the aerosolisable material when the consumable is in the heating zone 110 is configured for heating different sections of the heating zone 110 independently of each other, such as by way of comprising independently-controllable heatable elements 111.

In some embodiments, the heating material of the consumable 1, 2, 3, or of the heatable heating element 111 of the apparatus 100, is aluminium. However, in other embodiments, the heating material may comprise one or more materials selected from the group consisting of: an electrically-conductive material, a magnetic material, and a magnetic electrically-conductive material. In some embodiments, the heating material may comprise a metal or a metal alloy. In some embodiments, the heating material may comprise one or more materials selected from the group consisting of: aluminium, gold, iron, nickel, cobalt, conductive carbon, graphite, steel, plain-carbon steel, mild steel, stainless steel, ferritic stainless steel, molybdenum, silicon carbide, copper, and bronze. Other heating material(s) may be used in other embodiments.

In some embodiments, such as those in which the heating material comprises iron, such as steel (e.g. mild steel or stainless steel) or aluminium, the heating material may be coated to help avoid corrosion or oxidation of the heating material in use. Such coating may, for example, comprise nickel plating, gold plating, or a coating of a ceramic or an inert polymer.

In some embodiments, the consumable 1, 2, 3 may comprise heating material that is partially or fully embedded in the aerosolisable material of the consumable 1, 2, 3. In some embodiments, the aerosolisable material may comprise heating material. In some embodiments, the aerosolisable material may be free from heating material.

In some embodiments, the aerosolisable material comprises tobacco. However, in other embodiments, the aerosolisable material may consist of tobacco, may consist substantially entirely of tobacco, may comprise tobacco and aerosolisable material other than tobacco, may comprise aerosolisable material other than tobacco, or may be free from tobacco. In some embodiments, the aerosolisable material may comprise a vapour or aerosol forming agent or a humectant, such as glycerol, propylene glycol, triacetin, or diethylene glycol.

In some embodiments, the consumable is non-combustible. In some embodiments, the consumable is configured so as not to be combustible in use.

In some embodiments, once all, or substantially all, of the volatilisable component(s) of the aerosolisable material in the consumable 1, 2, 3 has/have been spent, the user may remove the consumable 1, 2, 3 from the heating zone of the apparatus 100 and dispose of the consumable 1, 2, 3. The user may subsequently re-use the apparatus 100 with another of the consumables 1, 2, 3. However, in other respective embodiments, the apparatus 100 and the consumable 1, 2, 3 may be disposed of together once the volatilisable component(s) of the aerosolisable material has/have been spent.

In some embodiments, the consumable 1, 2, 3 is sold, supplied or otherwise provided separately from the apparatus 100 with which the consumable 1, 2, 3 is usable. However, in some embodiments, the apparatus 100 and one or more of the consumables 1, 2, 3 may be provided together as a system, such as a kit or an assembly, possibly with additional components, such as cleaning utensils.

For the avoidance of doubt, where in this specification the term "comprises" is used in defining the invention or features of the invention, embodiments are also disclosed in which the invention or feature can be defined using the terms "consists essentially of" or "consists of" in place of "comprises". Reference to a material "comprising" certain features means that those features are included in, contained in, or held within the material.

In order to address various issues and advance the art, the entirety of this disclosure shows by way of illustration and example various embodiments in which the claimed invention may be practised and which provide for superior consumables for use with apparatus for heating aerosolisable material to volatilise at least one component of the aerosolisable material, and systems comprising such a consumable and such apparatus. The advantages and features of the disclosure are of a representative sample of embodiments only, and are not exhaustive and/or exclusive. They are presented only to assist in understanding and teach the claimed and otherwise disclosed features. It is to be understood that advantages, embodiments, examples, functions, features, structures and/or other aspects of the disclosure are not to be considered limitations on the disclosure as defined by the claims or limitations on equivalents to the claims, and that other embodiments may be utilised and modifications may be made without departing from the scope and/or spirit of the disclosure. Various embodiments may suitably comprise, consist of, or consist in essence of, various combinations of the disclosed elements, components, features, parts, steps, means, etc. The disclosure may include other inventions not presently claimed, but which may be claimed in future.

The invention claimed is:

1. A consumable for use with apparatus for heating aerosolisable material to volatilise at least one component of the aerosolisable material, wherein the consumable comprises:

an outer tube, an inner member inside the outer tube, wherein the inner member comprises a hollow inner tube that defines a passageway configured to receive a heating element of an apparatus for heating aerosolisable material, and at least one support that supports the inner member relative to the outer tube so that at least one air gap exists between the inner member and the outer tube;

wherein at least one of the inner member, the outer tube and the support comprises aerosolisable material that is heatable to generate aerosol in the air gap; and wherein the consumable has at least one outlet for permitting the aerosol to pass out of consumable from the air gap.

2. The consumable of claim 1, wherein the at least one support comprises a plurality of supports that are circumferentially spaced from each other.

3. The consumable of claim 1, wherein the at least one support is located between the inner member and the outer tube.

4. The consumable of claim 3, wherein the at least one support comprises an annular non-circular support between the inner member and the outer tube.

5. The consumable of claim 3, wherein the at least one support comprises a folded or corrugated element between the inner member and the outer tube.

6. The consumable of claim 1, wherein at least one of the inner member and the outer tube comprises the aerosolisable material.

7. The consumable of claim 6, wherein the at least one of the inner member and the outer tube comprises a carrier, and the aerosolisable material is affixed to the carrier.

8. The consumable of claim 1, wherein the at least one support comprises a heating material that is heatable by penetration with a varying magnetic field to thereby heat the aerosolisable material.

9. A system for heating aerosolisable material to volatilise at least one component of the aerosolisable material, the system comprising:

the consumable of claim 1; and apparatus for heating the aerosolisable material of the consumable to volatilise at least one component of the aerosolisable material, the apparatus comprising a heating zone for receiving the consumable, and a device for causing heating of the aerosolisable material when the consumable is in the heating zone.

10. The system of claim 9, wherein the device comprises a magnetic field generator for generating a varying magnetic field for penetrating the heating zone when the consumable is in the heating zone.

11. The system of claim 9, wherein the device of the apparatus comprises a heatable heating element in the heating zone; and wherein the inner member of the consumable comprises an inner tube that is located around a passageway that opens at an axial end of the consumable so that the heating element is insertable into the passageway.

12. A consumable for use with apparatus for heating aerosolisable material to volatilise at least one component of the aerosolisable material, wherein the consumable comprises:

an outer tube; and an inner member inside the outer tube, wherein the inner member comprises a hollow inner tube that defines a passageway configured to receive a heating element of an apparatus for heating aerosolisable material, wherein at least part of the inner member is spaced from the outer tube by at least one air gap, and wherein the inner member comprises aerosolisable material that is heatable to generate aerosol in the air gap;

wherein the consumable has at least one outlet for permitting the aerosol to pass out of consumable from the air gap.

13. The consumable of claim 1 or claim 12, wherein the inner member comprises a carrier, and the aerosolisable material is affixed to the carrier.

14. The consumable of claim 1 or claim 12, wherein the aerosolisable material comprises an amorphous solid.

15. A consumable for use with apparatus for heating aerosolisable material to volatilise at least one component of the aerosolisable material, wherein the consumable comprises:

an outer tube;

an inner member inside the outer tube, wherein the inner member comprises a hollow inner tube that defines a passageway configured to receive a heating element of an apparatus for heating aerosolisable material, wherein at least part of the inner member is spaced from the outer tube by at least one air gap; and aerosolisable material comprising an amorphous solid that is heatable to generate aerosol in the air gap;

wherein the consumable has at least one outlet for permitting the aerosol to pass out of consumable from the air gap.

16. The consumable of claim 1, claim 12, or claim 15, wherein at least one of the inner member and the outer tube is circular.

17. The consumable of clsim 1, claim 12, or claim 15, wherein the inner member and the outer tube are concentric.

18. The consumable of claim 1, claim 12, or claim 15, wherein the hollow inner tube is located around a passageway that opens at an axial end of the consumable so that a heating element for heating the aerosolisable material is insertable into the passageway in use.

19. The consumable of claim 1, claim 12, or claim 15, wherein the at least one outlet is at an axial end of the consumable.

20. The consumable of claim 1, claim 12, or claim 15, comprising heating material that is heatable by penetration with a varying magnetic field to thereby heat the aerosolisable material.

21. The consumable of claim 20, wherein the heating material comprises one or more materials selected from the group consisting of: an electrically-conductive material, a magnetic material, and a magnetic electrically-conductive material.

22. The consumable of claim 20, wherein the heating material comprises a metal or a metal alloy.

23. The consumable of claim 20, wherein the heating material comprises one or more materials selected from the group consisting of: aluminium, gold, iron, nickel, cobalt, conductive carbon, graphite, steel, plain-carbon steel, mild steel, stainless steel, ferritic stainless steel, molybdenum, silicon carbide, copper, and bronze.

24. The consumable of claim 20, wherein at least one of the inner member and the outer tube comprises the heating material.

* * * * *